US005916742A

United States Patent [19]

Ikari et al.

[11] Patent Number: 5,916,742

[45] **Date of Patent: *Jun. 29, 1999**

[54] SURFACE LATENT IMAGE TYPE PHOTOGRAPHIC MATERIAL CONTAINING SILVER HALIDE GRAINS DOPED WITH CYANO-CHROMIUM-COMPLEX ION

[75] Inventors: Shinji Ikari; Naoto Oshima, both of Kanagawa, Japan

[73] Assignee: Fuji Photo Film Co., Ltd., Kanagawa, Japan

[ * ] Notice: This patent is subject to a terminal disclaimer.

[21] Appl. No.: 08/866,293

[22] Filed: May 30, 1997

Related U.S. Application Data

[63] Continuation of application No. 08/358,554, Dec. 14, 1994, abandoned.

[30] Foreign Application Priority Data

Dec. 14, 1993 [JP] Japan ..... 5-313557

[51] Int. Cl.[6] ..... G03C 1/035; G03C 1/36

[52] U.S. Cl. ..... 430/567; 430/604; 430/611; 430/615

[58] Field of Search ..... 430/567, 604, 430/611, 615

[56] References Cited

U.S. PATENT DOCUMENTS

| | | | |
|---|---|---|---|
| 4,806,462 | 2/1989 | Yamashita et al. | 430/604 |
| 5,759,758 | 6/1998 | Yamazaki et al. | 430/567 |

FOREIGN PATENT DOCUMENTS

| | | | |
|---|---|---|---|
| 488601 | 6/1992 | European Pat. Off. | 430/604 |
| 488737 | 6/1992 | European Pat. Off. | 430/604 |

*Primary Examiner*—John A. McPherson

*Attorney, Agent, or Firm*—Birch, Stewart, Kolasch & Birsch, LLP

[57] ABSTRACT

A surface latent image type silver halide photographic material comprises a support and at least one surface latent image type silver halide emulsion layer provided thereon. Surface latent image type silver halide grains of the emulsion layer contain a cyano-chromium-complex ion represented by the formula (I):

$$[Cr(CN)_{6-n}L_n]^{m-} \quad (I)$$

wherein L is $H_2O$ or OH; n is 0 or 1; and m is 3 or 4.

13 Claims, No Drawings

SURFACE LATENT IMAGE TYPE PHOTOGRAPHIC MATERIAL CONTAINING SILVER HALIDE GRAINS DOPED WITH CYANO-CHROMIUM-COMPLEX ION

This application is a continuation of application Ser. No. 08/358,554 filed on Dec. 14, 1994, now abandoned.

FIELD OF THE INVENTION

The present invention relates to a surface latent image type silver halide photographic material. In more detail, the invention relates to a surface latent image type silver halide photographic material of hard gradation, which shows a characteristic curve having a steep rise at its toe.

BACKGROUND OF THE INVENTION

A silver halide photographic material requires high sensitivity, fine graininess and low fog as basic capabilities. A means of satisfying the requirements is a metal doping technique. The metal doping technique is conducted to improve the characteristics of silver halide grains and to increase the efficiency of changing a photoelectron into a developable latent image (quantum sensitivity). In more detail, a metal ion or a metal complex containing a ligand is incorporated into silver halide grains according to the metal doping technique. In other words, the grains are doped with the metal ion or the metal complex. According to the metal doping, the characteristics of silver halide grains can be improved to obtain a required capability of an emulsion.

A general and practical surface latent image type silver halide photographic emulsion further requires hard gradation. Particularly, a light-sensitive material for graphic arts should have hard gradation even though the sensitivity is degraded. The hard gradation means that a characteristic curve of an emulsion (abscissa: exposure, ordinate: optical density) has a steep slope at a gradation portion (straight line portion). A steep rise at the toe (an exposure portion having an optical density lower than the density of the gradation portion) of the characteristic curve is also important about the gradation. A conventional silver halide photographic material such as a color paper also requires the hard gradation, namely the steep rise at the toe of the characteristic curve to obtain a clean and clear image.

Research Disclosure 17643, item IA describes metal ions or metal complexes, which can be incorporated into silver halide grains according to the metal doping technique.

At an initial stage of the metal doping technique, metal complexes of platinum, palladium, iridium, rhodium and ruthenium have been frequently used. These water-soluble complexes are described in U.S. Pat. No. 2,448,060. The metal complexes function as an antifogging agent or a stabilizer after silver halide grains are doped with the complexes. Hexa-coordinated cyano-complex of palladium (IV) further has a sensitizing effect. The complexes disclosed in the Patent have a halide compound (such as chloride or bromide compound) as a ligand.

U.S. Pat. No. 3,690,888 discloses a process for preparation of silver halide containing a polyvalent metal ion. The process includes a step of forming silver halide grains in the presence of a protective colloid substantially consisting of an acrylic polymer. The U.S. Patent discloses bismuth, iridium, lead and osmium ions as examples of the polyvalent metal ion. The Patent further discloses complexes of the metal ions. The complexes have a halide compound (such as chloride or bromide compound) as a ligand.

The above-mentioned documents disclose the effects of the metal ions incorporated into silver halide grains.

Japanese Patent Publication No. 48(1973)-35373 discloses potassium hexacyanoferrate(II) and (III) as dopants containing cyano ion. The effect of the disclosed invention does not relate to the nature of the ligand. The effect is limited to a complex having an iron ion.

U.S. Pat. No. 3,790,390 discloses a spectrally sensitized silver halide emulsion containing a cyano complex of iron (II), iron(III) or cobalt(III).

U.S. Pat. No. 4,847,191 discloses silver halide grains, which are formed in the presence of a rhodium(III) complex having 3, 4, 5 or 6 ligands. This document reports that these grains reduce high intensity reciprocity law failure of a silver halide emulsion.

The above-mentioned documents also disclose the effects of the metal ions incorporated into silver halide grains.

Japanese Patent Provisional Publication Nos. 2(1990)-20853 and 2(1990)-20854 disclose silver halide grains, which are formed in the presence of a complex of rhenium, ruthenium, osmium or iridium having 4 or more cyano ligands. As is described in these documents, the emulsion containing these grains has an effect of improving stability about sensitivity. The emulsion has another effect of reducing low intensity reciprocity law failure.

Japanese Patent Provisional Publication Nos. 2(1990)-20852, 2(1990)-20855, 3(1991)-118535 and 3(1991)-118536 disclose a combination of a cyanide ion and a cross-lining ligand (e.g., NO, NS, CO, (O)2).

The above-mentioned documents propose a new concept that seven vacant lattices of one silver ion and six neighboring halide ions are occupied with a hexa-coordinated metal complex consisting of one metal ion and six ligands.

Japanese Patent Provisional Publication No. 6(1994)-51423 (corresponding to European Patent Publication No. 0573066A1) discloses an internal latent image type direct positive silver halide emulsion doped with a hexa-coordinated cyano-metal-complex. The metal is chromium, manganese, cobalt, iridium, ruthenium, rhodium, rhenium or osmium. The effect of the disclosed invention is to obtain an internal latent image type direct positive silver halide of high sensitivity as well as hard gradation.

The internal latent image type silver halide emulsion forms a latent image mainly inside silver halide grains by light exposure. A direct image is formed by the specific character of the internal latent image type emulsion. The image forming process comprises imagewise exposing to light a photographic material having the emulsion and developing the material with a surface developing solution (which selectively does not develop silver halide grains having an internal latent image) while uniformly exposed to light the material or treating the material with a nucleating agent. The internal latent image type direct positive silver halide emulsion has a relatively low sensitivity (compared with the below-mentioned surface latent image type silver halide emulsion) because of the above-mentioned complicated process. Therefore, a high sensitivity is usually required about improvement of the internal latent image type direct positive silver halide emulsion.

On the other hand, a general silver halide emulsion is a surface latent image type, which forms a latent image mainly on the surface of silver halide grains by light exposure. An image forming process using the surface latent image type emulsion comprises imagewise exposing to light a photographic material having the emulsion and developing the material with a developing solution to develop silver halide grains having a surface latent image selectively. The surface latent image type silver halide emulsion has a relatively high sensitivity. Accordingly, photographic characteristics other than sensitivity are sometimes improved, even though the sensitivity is degraded. For example, gradation is hardened for some use of the photographic material while desensitizing the emulsion. The effect of hard gradation with desensitization (desensitizing hard gradation) is different from the effect of the invention disclosed in Japanese Patent Provisional Publication No. 6(1994)-51423, which is not accompanied by desensitization.

As is described above, the internal latent image type emulsion is completely different from the surface latent image type emulsion in the basic image forming mechanism. Therefore, the metal doping effect of the internal latent image type emulsion is sometimes different from the effect of the surface latent image type emulsion.

The metal doping technique is conducted to change the efficiency of changing a photoelectron into a developable latent image. The effect of the metal doping depends on whether the latent image is present inside or surface of the grains.

SUMMARY OF THE INVENTION

An object of the present invention is to provide a surface latent image type silver halide emulsion of desensitizing hard gradation, which shows a characteristic curve having a steep rise at its toe.

The present invention provides a surface latent image type silver halide photographic material which comprises a support and at least one surface latent image type silver halide emulsion layer provided thereon, wherein surface latent image type silver halide grains of the emulsion layer contain a cyano-chromium-complex ion represented by the formula (I):

$$[Cr(CN)_{6-n}L_n]^{m-} \quad (I)$$

wherein L is $H_2O$ or OH; n is 0 or 1; and m is 3 or 4.

According to study of the present inventors, a hard image can be obtained by doping the surface latent image type silver halide grains with the cyano-chromium-complex ion. The toe of the characteristic curve is improved to show a very steep rise. The effect is unexpectedly remarkable though the sensitivity is considerably degraded.

As is described above, the general and practical surface latent image type silver halide emulsion sometimes requires a very hard gradation even though the sensitivity is degraded. For example, image quality is more important than the sensitivity in a color paper or a light-sensitive material for graphic arts. The silver halide photographic material is particularly advantageous to such use requiring the best image quality.

DETAILED DESCRIPTION OF THE INVENTION

The silver halide emulsion used in the silver halide photographic material is a surface latent image type. The surface latent image type emulsion forms a latent image mainly on the surface of silver halide grains by light exposure. The surface latent image type emulsion is determined by the following experiments.

An appropriate amount of a silver halide emulsion is coated on transparent supports to obtain two samples. The samples are exposed to light for a determined time in the range of 0.01 to 1 second. One sample is developed with the following surface developing solution at 20° C. for 5 minutes. The other sample is developed with the following internal developing solution at 20° C. for 5 minutes. The surface latent image type emulsion is so defined that the maximum density of the surface developed sample is larger than the maximum density of the internal developed sample. The maximum density can be measured according to a conventional photographic measuring method.

| Surface developing solution | | |
|---|---|---|
| N-methyl-p-aminophenol sulfite | 2.5 | g |
| 1-Ascorbic acid | 10 | g |
| Potassium metanitrate | 35 | g |
| Potassium bromide | 1 | g |
| Water (make up to) | 1 | liter |
| **Internal developing solution** | | |
| N-methyl-p-aminophenol sulfite | 2 | g |
| Sodium nitrite (anhydride) | 90 | g |
| Hydroquinone | 8 | g |
| Sodium carbonate (monohydrate) | 52.5 | g |
| Potassium bromide | 5 | g |
| Potassium iodide | 0.5 | g |
| Water (make up to) | 1 | liter |

According to the present invention, the above-mentioned surface latent image type silver halide grains are doped with a cyano-chromium-complex ion, which is represented by the formula (I):

$$[Cr(CN)_{6-n}L_n]^{m-} \quad (I)$$

In the formula (I), L is $H_2O$ or OH; n is 0 or 1 (preferably 0); and m is 3 or 4 (preferably 3).

The cyano-chromium-complex ion is soluble in water. The ion is free in an aqueous solution. Accordingly, the counter cation is not so technically important. Therefore, the counter ion can be selected from ions that are soluble in water and are appropriate for procedures of precipitating the silver halide emulsion. Examples of the counter cations include an alkali metal ion (e.g., sodium ion, potassium ion, rubidium ion, cesium ion, lithium ion), ammonium ion and alkylammonium ion. The alkylammonium ion is represented by the following formula (II).

$$[R^1R^2R^3R^4N]^+ \quad (II)$$

In the formula (II), each of $R^1$, $R^2$, $R^3$ and $R^4$ independently is a lower alkyl group having 1 to 6 carbon atoms. Examples of the lower alkyl groups include methyl, ethyl propyl, iso-propyl and n-butyl. $R^1$, $R^2$, $R^3$ and $R^4$ are preferably identical. Examples of the preferred alkylammonium ions include tetramethylammonium ion, tetraethylammonium ion, tetrapropylammonium ion and tetra(n-butyl) ammonium ion.

The cyano-chromium-complex ion is preferably dissolved in water or a mixed solvent of water with an organic solvent to prepare a solution for addition. Examples of the organic solvents miscible with water include alcohols, ethers, glycols, ketones, esters and amides.

The solution of the cyano-chromium-complex ion can be directly added to a reaction solution at the stage of silver halide grain formation. The solution of the ion can also be added to an aqueous halide solution or another solution for silver halide grain formation before the formation.

The cyano-chromium-complex ion can be uniformly present in the silver halide grains after the grains are doped with the complex ion. Further, the surface of the grain can be doped with the ion at a higher concentration. Furthermore, the cyano-chromium-complex ion can be introduced into a surface phase of the grain by conducting a physical ripening in the presence of fine silver halide grains doped with the ion.

Japanese Patent Provisional Publication Nos. 2(1990)-125245, 3(1991)-188437 and 4(1992)-208936 disclose a process for doping the surface of the grain with a cyano-metal-complex ion at a higher concentration. U.S. Pat. Nos. 5,252,451 and 5,256,530 disclose a process of using fine silver halide grains doped with a cyano-metal-complex ion. The same processes are available in the cyano-chromium-complex ion of the present invention.

In principle, the cyano-chromium-complex ion is preferably uniformly present in the silver halide grains. However, the crystal structure may be influenced with the complex ion when the ion is added to the emulsion at the stage of forming fine crystal nuclei. The fine nuclei have an average diameter size in the range of 0.04 to 0.2 $\mu$m. The ion is preferably added to the emulsion after the stage of forming fine crystal nuclei. The cyano-chromium-complex ion is preferably uniformly present in the other portions of the grains than the fine crystal nuclei.

The doped amount of the cyano-chromium-complex ion is preferably in the range of $1\times10^{-8}$ to $1\times10^{-2}$ mol, more preferably in the range of $1\times10^{-7}$ to $1\times10^{-3}$ mol, and most preferably in the range of $1\times10^{-7}$ to $1\times10^{-4}$ mol based on 1 mol of silver halide.

The reaction solution to which the cyano-chromium-complex ion is added preferably has a hydrogen ion concentration of pH 3 or more.

The amount of the doped metal complex in silver halide grains can be determined by measuring the center metal (chromium in the present invention) of the doped metal complex. Atomic absorption analysis, ICP (inductively coupled plasma spectrometry) analysis and ICPMS (inductively coupled plasma mass spectrometry) analysis are available.

Examples of the cyano-chromium-complex ions are shown below.

$$[Cr(CN)_6]^{3-} \quad \text{(I-1)}$$

$$[Cr(CN)_5(H_2O)]^{3-} \quad \text{(I-2)}$$

$$[Cr(CN)_5(OH)]^{4-} \quad \text{(I-3)}$$

The photographic effect of the cyano-chromium-complex ion is different from the effect of the other cyano-metal-complex ions. The present inventors assume the different effects as follows.

Light adsorbed in silver halide grains forms photoelectron and positive hole. The lifetime of the excited photoelectron can be measured according to a microwave photoconductive method. For example, the lifetime of the photoelectron is extended, and a shallow electron trap is formed in an emulsion doped with a hexa-coordinated cyano-metal-complex of the VIII group such as iron, ruthenium, cobalt, iridium (disclosed in Japanese Patent Provisional Publication No. 6(1994)-51423). As is well known, the electron trap increase the provability of forming latent image in the grain. Thus, the photographic sensitivity is increased.

On the other hand, the lifetime of the excited electron is remarkably short in the grains containing the cyano-chromium-complex of the present invention. Accordingly, the cyano-chromium-complex probably has a strong function of capturing an electron. This function is supposed to cause the photographic desensitization and the hard gradation.

As is described above, the photographic effect of the cyano-chromium-complex is clearly different from the effect of the hexa-coordinated cyano-metal-complex of the VIII group in view of the physical characteristics of the doped grains.

The surface latent image type silver halide emulsion layer preferably further contains a mercapto heterocyclic compound. A preferred mercapto heterocyclic compound is represented by the following formula (III).

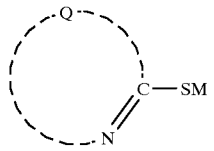

(III)

In the formula (III), Q is an atomic group forming five-membered or six-membered heterocyclic ring; M is a cation. An aromatic ring (e.g., benzene ring) may be condensed with the heterocyclic ring.

Examples of the heterocyclic rings formed by Q include imidazole ring, tetrazole ring, thiazole ring, oxazole ring, selenazole ring, benzimidazole ring, naphthimidazole ring, benzthiazole ring, naphthothiazole ring, benzoselenazole ring, naphthoselenazole ring and benzoxazole ring.

Examples of the cations represented by M include proton, an alkali metal (e.g., sodium, potassium) ion and ammonium ion.

More preferred mercapto heterocyclic compounds are represented by the following formulas (III-1), (III-2), (III-3) and (III-4).

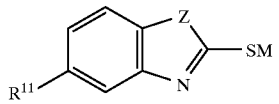

(III-1)

In the formula (III-1), $R^{11}$ is hydrogen, an alkyl group, an alkoxy group, an aryl group, a halogen atom, a carboxyl group or a salt thereof, a sulfo group or a salt thereof or an amino group; Z is —NH—, —O— or —S—; and M is a cation.

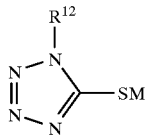

(III-2)

In the formula (III-3), $R^{12}$ is an aryl group or a cycloalkyl group; and M is a cation. The aryl group and the cycloalkyl group may have one or more substituent groups. Examples of the aryl group and the cycloalkyl group are shown below.

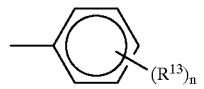

-continued

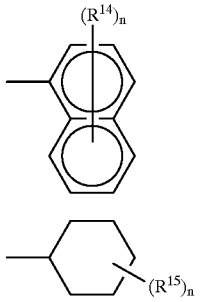

In the above formulas, each of $R^{13}$, $R^{14}$ and $R^{15}$ is an alkyl group, an alkoxy group, a carboxyl group or a salt thereof, a sulfo group or a salt thereof, hydroxyl, an amino group, an amido group, a carbamoyl group or a sulfonamido group; and n is 0, 1 or 2.

With respect to $R^{11}$, $R^{13}$, $R^{14}$ and $R^{15}$ of the formulas (III-1) and (III-2), examples of the alkyl groups include methyl, ethyl and butyl. Examples of the alkoxy groups include methoxy and ethoxy. Examples of the salts of the carboxyl or sulfo groups include sodium salt and ammonium salt.

With respect to $R^{11}$ of the formula (III-1), examples of the aryl groups include phenyl and naphthyl. Examples of the halogen atoms include chlorine and bromine.

With respect to $R^{13}$, $R^{14}$ and $R^{15}$ in the formula (III-2), examples of the amido groups include acetamido and benzamido. Examples of the carbamoyl groups include ethylcarbamoyl and phenylcarbamoyl. Examples of the sulfonamido groups include methanesulfoamido and benzenesulfonamido.

The above-mentioned alkyl, aryl, amino, amido, carbamoyl and sulfonamido groups may have one or more substituent groups. For example, an amino group substituted with an alkylcabamoyl group, namely an alkyl substituted ureido group is included in the substituted amino group.

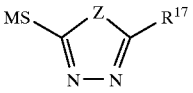

(III-3)

In the formula (III-3), Z is —$N^{16}$—, oxygen or sulfur; $R^{17}$ is hydrogen, an alkyl group, an aryl group, an alkenyl group, a cycloalkyl group, —$SR^{18}$, —$NR^{19}R^{20}$, —$NHCOR^{21}$, —$NHSO_2R^{22}$ or a heterocyclic group; each of $R^{16}$ and $R^{18}$ independently is hydrogen, an alkyl group, an alkenyl group, a cycloalkyl group, an aryl group, —$COR^{23}$ or —$SO_2R^{24}$; each of $R^{19}$ and $R^{20}$ independently is hydrogen, an alkyl group or an aryl group; each of $R^{21}$, $R^{22}$, $R^{23}$ and $R^{24}$ independently is an alkyl group or an aryl group; and M is a cation.

With respect to $R^{16}$, $R^{17}$, $R^{18}$, $R^{19}$, $R^{20}$, $R^{21}$, $R^{22}$, $R^{23}$ and $R^{24}$ in the formula (III-3), examples of the alkyl groups include methyl, benzyl, ethyl and propyl. Examples of the aryl groups include phenyl and naphthyl.

With respect to $R^{16}$, $R^{17}$ and $R^{18}$ in the formula (III-3), an example of the alkenyl group is propenyl. An example of the cycloalkyl group is cyclohexyl.

With respect to $R^{17}$ in the formula (III-3), examples of the heterocyclic groups include furyl and pyridinyl.

The above-mentioned alkyl, aryl, alkenyl, cycloalkyl and heterocyclic groups may have one or more substituent groups. For example, an alkyl group substituted with an aryl group, namely an aralkyl group is included in the substituted alkyl group.

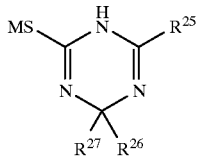

(III-4)

In the formula (III-4), $R^{25}$ has the same meaning as defined about $R^{17}$ of the formula (III-3); M is a cation; and each of $R^{26}$ and $R^{27}$ has the same meaning as defined about $R^{16}$ and $R^{19}$ in the formula (III-3).

Examples of the compounds represented by the formula (III) are shown below.

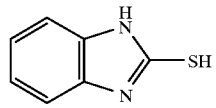

III-1-1

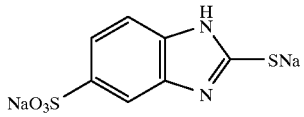

III-1-2

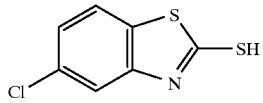

III-1-3

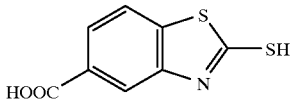

III-1-4

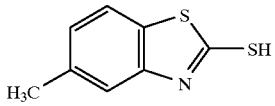

III-1-5

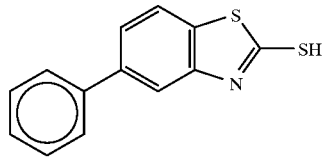

III-1-6

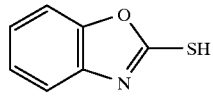

III-1-7

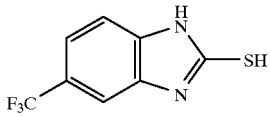

III-1-8

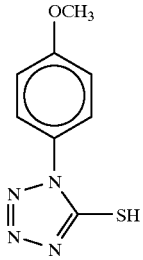

III-2-1

-continued
III-2-2
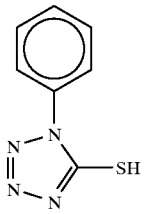
III-2-3
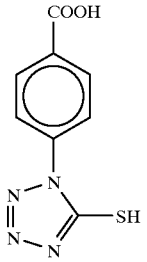
III-2-4
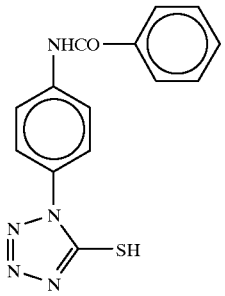
III-2-5
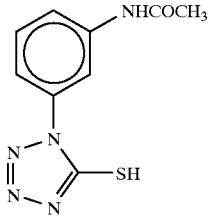
III-2-6
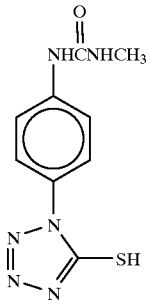
III-3-1
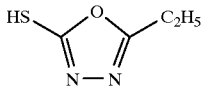
III-3-2
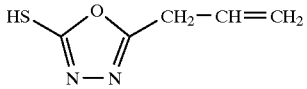
III-3-3
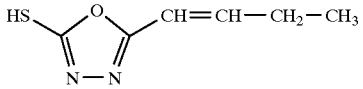
-continued
III-3-4
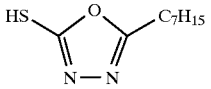
III-3-5
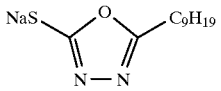
III-3-6
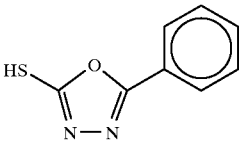
III-3-7
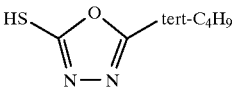
III-3-8
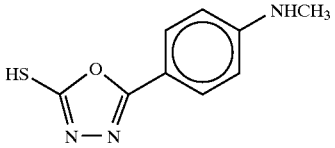
III-3-9
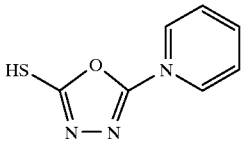
III-3-10
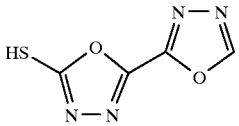
III-3-11
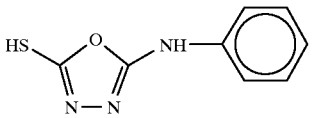
III-3-12
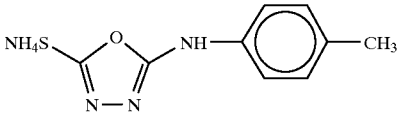
III-3-13
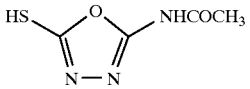
III-3-14
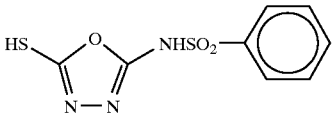
III-3-15
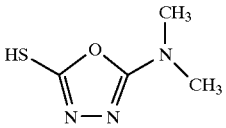
III-3-16
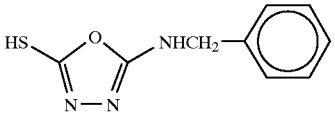
III-3-17
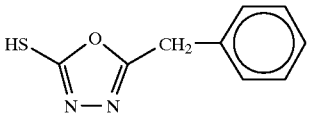

-continued
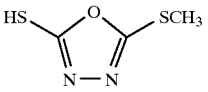
III-3-18
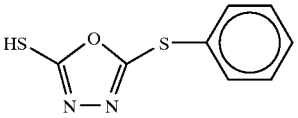
III-3-19
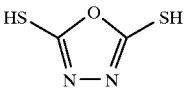
III-3-20
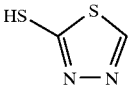
III-3-21
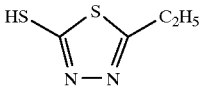
III-3-22
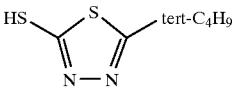
III-3-23
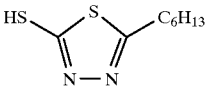
III-3-24
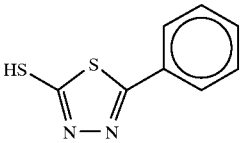
III-3-25
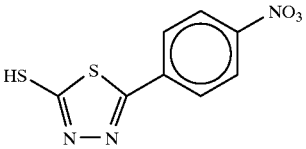
III-3-26
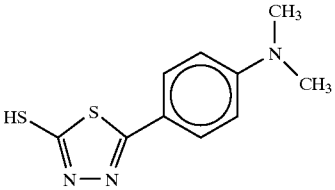
III-3-27
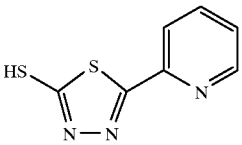
III-3-28
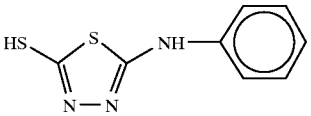
III-3-29
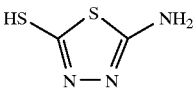
III-3-30
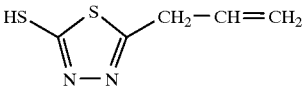
III-3-31
-continued
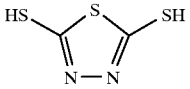
III-3-32
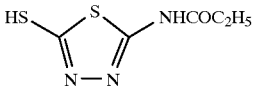
III-3-33
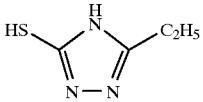
III-3-34
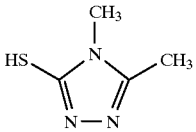
III-3-35
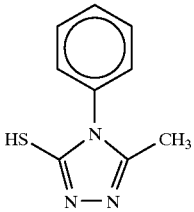
III-3-36
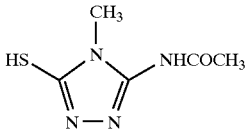
III-3-37
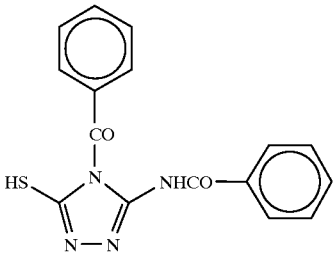
III-3-38
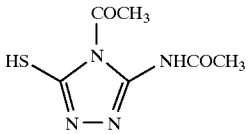
III-3-39
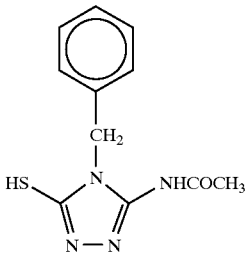
III-3-40
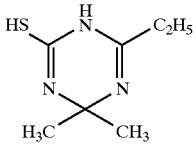
III-4-1

-continued

III-4-2

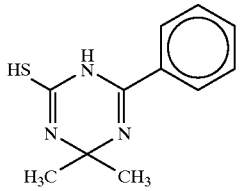

III-4-3

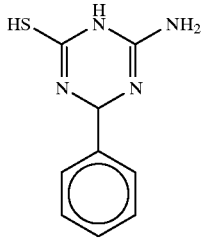

III-4-4

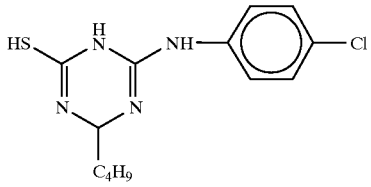

III-4-5

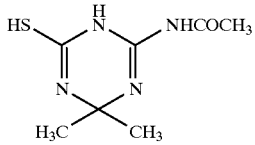

III-4-6

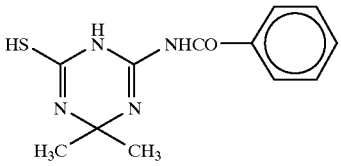

III-4-7

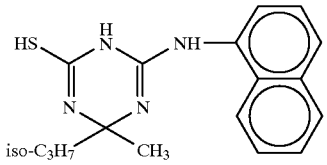

III-4-8

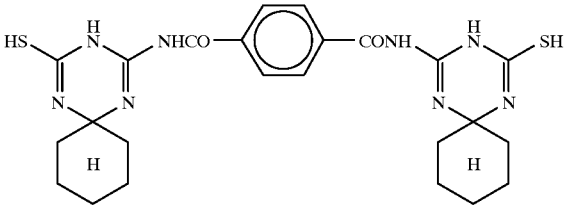

The amount of the mercapto heterocyclic compound is preferably in the range of $1\times10^{-5}$ to $5\times10^{-2}$ mol, and more preferably in the range of $1\times10^{-4}$ to $1\times10^{-2}$ mol based on 1 mol of silver halide.

There is no specific limitation with respect to the methods of adding the mercapto heterocyclic compound to the surface latent image type silver halide emulsion layer. The compound can be used at the stage of preparation of the emulsion layer (including silver halide grain formation, physical ripening, chemical sensitization and preparation of the coating solution).

The surface latent image type silver halide emulsion preferably further contains a tetrazaindene compound. A preferred tetrazaindene compound is represented by the following formulas (IV) and (V).

(IV)

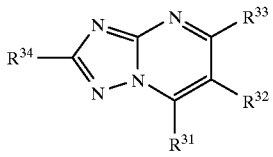

(V)

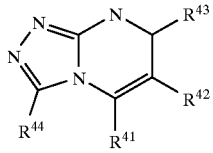

In the formulas (IV) and (V), each of $R^{31}$, $R^{32}$, $R^{33}$, $R^{34}$, $R^{41}$, $R^{42}$, $R^{43}$ and $R^{44}$ independently is hydrogen, an alkyl group, an aryl group, an amino group, hydroxyl, an alkoxy group, an alkylthio group, a carbamoyl group, a halogen atom, cyano, carboxyl, an alkoxycarbonyl group or a heterocyclic group; and $R^{31}$ and $R^{32}$, $R^{32}$ and $R^{33}$, $R^{41}$ and $R^{42}$ or $R^{42}$ and $R^{43}$ may be combined with each other to form a five-membered or six-membered ring. At least one of $R^{31}$ and $R^{32}$ is hydroxyl. At least one of $R^{41}$ and $R^{42}$ is also hydroxyl.

The alkyl group may be cyclic or branched. The alkyl group preferably has 1 to 20 carbon atoms. The alkoxy group preferably has 1 to 20 carbon atoms. The alkylthio group preferably has 1 to 6 carbon atoms. The alkoxycarbonyl group preferably has 2 to 20 carbon atoms. the heterocyclic ring preferably has a five-membered or six-membered ring. Examples of the hetero atoms of the ring include nitrogen, oxygen and sulfur. The above-mentioned alkyl, aryl, amino and carbamoyl groups may have one or more substituent groups. Examples of the substituent groups include an aliphatic group and an aromatic group.

The tetrazaindene compound may form a polymer. A repeating unit of such a polymer is represented by the following formula (VI).

(VI)

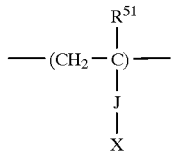

In the formula (VI), $R^{51}$ is hydrogen or an alkyl group; X is a monovalent group formed by removing one hydrogen atom from the compound represented by the formula (IV) or (V); and J is a divalent linking group. X may be formed by removing one hydrogen atom from $R^{31}$, $R^{32}$, $R^{33}$, $R^{34}$, $R^{41}$, $R^{42}$, $R^{43}$ or $R^{44}$ in the formula (IV) or (V).

Examples of the alkyl groups in the formulas (IV), (V) and (VI) include methyl, ethyl, n-propyl, iso-propyl, n-butyl, iso-butyl, tert-butyl, hexyl, cyclohexyl, cyclopentylmethyl, octyl, dodecyl, tridecyl and heptadecyl. Examples of the substituent groups of the alkyl groups include an aryl group, a heterocyclic group, a halogen atom, carboxyl, an alkoxycarbonyl group (preferably having 2 to 6 carbon atoms), an alkoxy group (preferably having 1 to 19 carbon atoms) and hydroxyl.

Examples of the substituted alkyl groups include benzyl, phenethyl, chloromethyl, 2-chloroethyl, trifluoromethyl, carboxymethyl, 2-carboxyethyl, 2-(methoxycarbonyl)ethyl, ethoxycarbonylmethyl, 2-methoxyethyl, hydroxymethyl and 2-hydroxyethyl.

Examples of the aryl groups include phenyl and naphthyl. Examples of the substituent groups of the aryl groups include an alkyl group (preferably having 1 to 4 carbon atoms), a halogen atom, carboxyl, cyano and an alkoxycarbonyl group (preferably having 2 to 6 carbon atoms). Examples of the substituted aryl groups include p-tolyl, m-tolyl, p-chlorophenyl, p-bromophenyl, o-chlorophenyl, m-cyanophenyl, p-carboxyphenyl, o-carboxyphenyl, o-(methoxycarbonyl)phenyl, p-hydroxyphenyl, p-methoxyphenyl and m-ethoxyphenyl.

Examples of the substituent groups of the amino groups include an alkyl group (e.g., methyl, ethyl, butyl), an acyl group (e.g., acetyl, propionyl, benzoyl) and a sulfonyl group (e.g., methanesulfonyl). Examples of the substituted amino groups include dimethylamino, diethylamino, butylamino and acetamido.

Examples of the alkoxy groups include methoxy, ethoxy, butoxy and heptadecyloxy.

Examples of the alkylthio groups include methylthio, ethylthio and hexylthio.

Examples of the substituent groups of the carbamoyl groups include an alkyl group (preferably having 1 to 20 carbon atoms) and an aryl group (e.g., phenyl, naphthyl). Examples of the substituted carbamoyl groups include methylcarbamoyl, dimethylcarbamoyl, ethylcarbamoyl and phenylcarbamoyl.

Examples of the alkoxycarbonyl groups include methoxycarbonyl, ethoxycarbonyl and butoxycarbonyl.

Examples of the halogen atoms include fluorine, chlorine and bromine.

The heterocyclic group may form a condensed ring having two or three rings. Examples of the heterocyclic groups include furyl, pyridyl, 2-(3-methyl)benzothiazolyl and 1-benzotriazolyl.

In the case that the alkyl group of $R^{34}$ or $R^{44}$ is substituted with a heterocyclic group, a preferred heterocyclic group is represented by the following formula (VII).

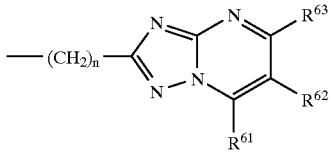

(VII)

In the formula (VII), each of $R^{61}$, $R^{62}$ and $R^{63}$ has the same meaning as defined as $R^{31}$, $R^{32}$ and $R^{33}$ in the formula (IV); and n is 2, 3 or 4.

Examples of the compounds represented by the formulas (IV), (V) and (VI) are shown below.

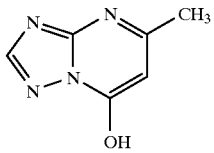

IV-1

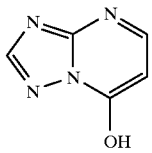

IV-2

-continued

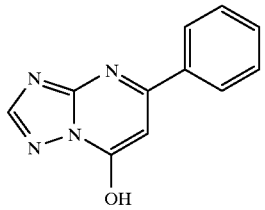

IV-3

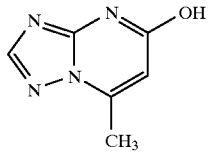

IV-4

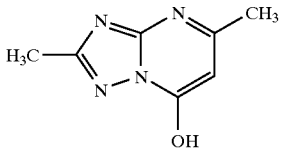

IV-5

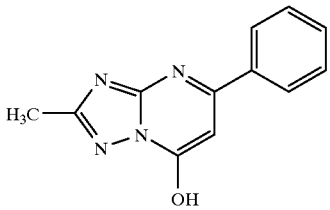

IV-6

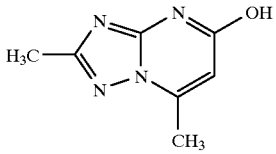

IV-7

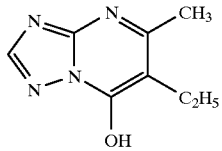

IV-8

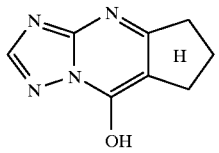

IV-9

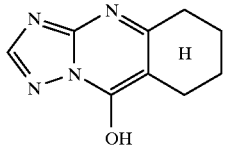

IV-10

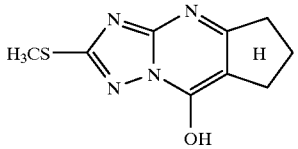

IV-11

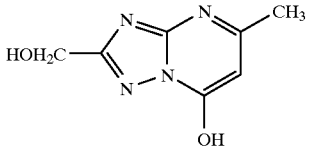

IV-12

-continued
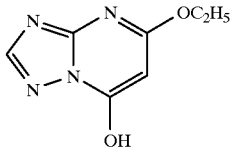
IV-13
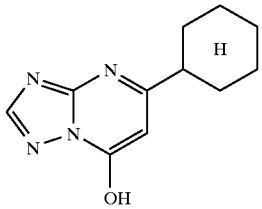
IV-14
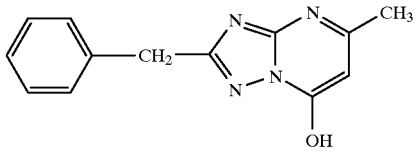
IV-15
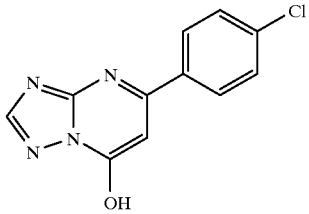
IV-16
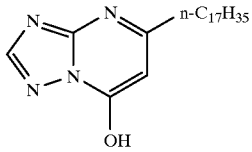
IV-17
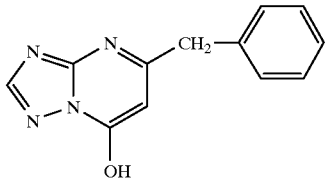
IV-18
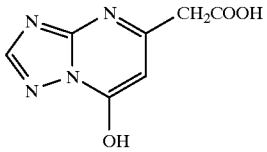
IV-19
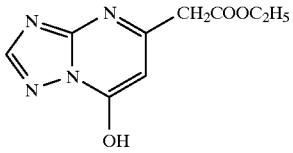
IV-20
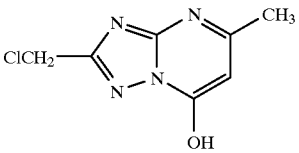
IV-21
-continued
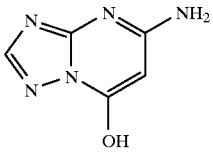
IV-22
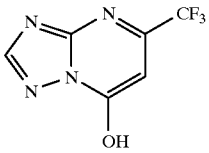
IV-23
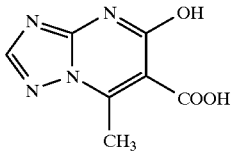
IV-24
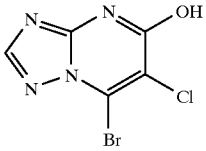
IV-25
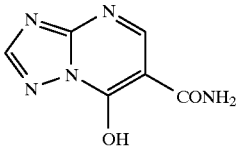
IV-26
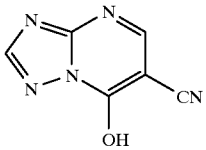
IV-27
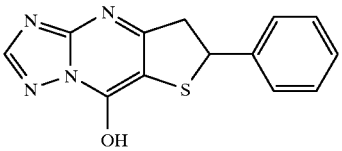
IV-28
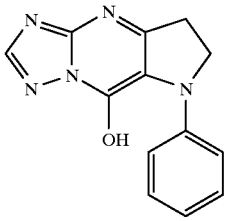
IV-29
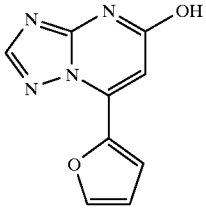
IV-30

-continued

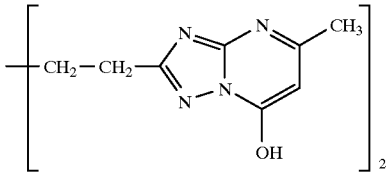

IV-31

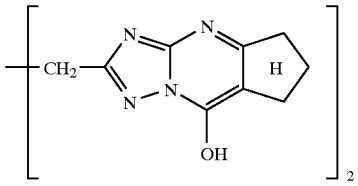

IV-32

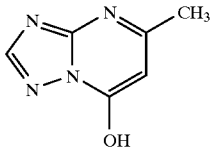

V-1

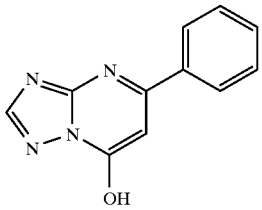

V-2

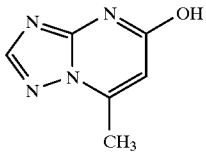

V-3

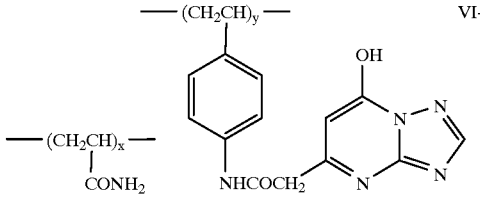

VI-1

Copolymer, y = 5 to 50 (mol %)

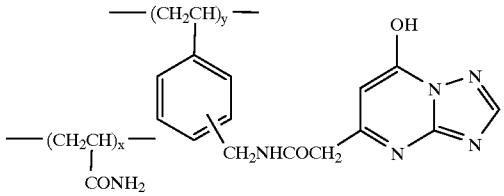

VI-2

Copolymer, y = 5 to 50 (mol %)

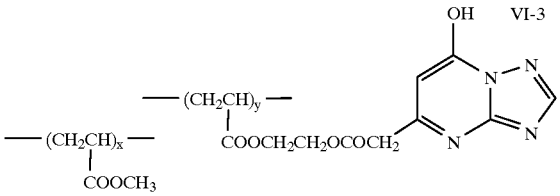

VI-3

Copolymer, y = 5 to 50 (mol %)

-continued

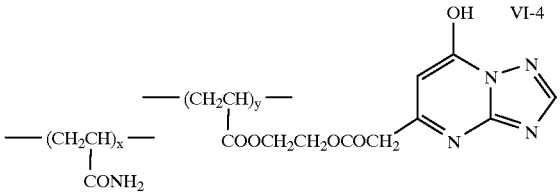

VI-4

Copolymer, y = 5 to 50 (mol %)

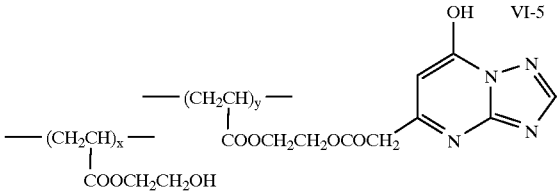

VI-5

Copolymer, y = 5 to 50 (mol %)

The amount of the tetrazaindene compound is preferably in the range of $1\times10^{-5}$ to $3\times10^{-1}$ mol, and more preferably in the range of $3\times10^{-4}$ to $1\times10^{-1}$ mol based on 1 mol of silver halide. The amount depends on the grain size and halogen composition of the silver halide emulsion, the process and effect of the chemical sensitization, the relation between the surface latent image type emulsion layer and the other layers and the nature of the antifogging agent. Accordingly, the amount is preferably determined by a preliminary experiment.

The tetrazaindene compound can easily be incorporated into the silver halide emulsion layer by adding the compound to the emulsion. The compound may be incorporated into a non-light-sensitive layer by adding the compound to a coating solution of the layer. The compound is preferably used in the form of a solution. Water and an organic solvent is available for a solvent of the solution. The organic solvent is preferably miscible with water. Examples of the organic solvents include alcohols (e.g., methanol, ethanol), esters (e.g., ethyl acetate) and ketones (e.g., acetone). The tetrazaindene compound is sometimes well dissolved in an alkaline solution. In such a case, the alkaline solution is conveniently used.

The tetrazaindene compound can be added to a silver halide emulsion at any stages between formation of silver halide grains and coating of the emulsion. The compound is preferably added to the emulsion after the chemical sensitization is initiated. The compound is more preferably added after the chemical sensitization is completed and before the emulsion is coated.

The silver halide grains doped with the cyano-chromium-complex show hard gradation and a steep rise at a toe of a characteristic curve. The preservablity (stability) and the maximum optical density can be further improved by adding the mercapto heterocyclic compound or the tetrazaindene compound.

Each of the mercapto heterocyclic compound and the tetrazaindene compound independently shows a sufficient effect. Two or more heterocyclic compounds or the tetrazaindene compounds may be used in combination. Further, the mercapto heterocyclic compound can be used in combination with the tetrazaindene compound.

The silver halide grains preferably has such a halide composition that silver chloride content is 50 mol % or more. The silver chloride content more preferably is 80 mol % or more, and most preferably is 90 % or more. In the present invention, silver chloride, silver chlorobromide and silver chloroiodobromide are preferably available.

Particularly, silver halide grains preferably consist of silver chlorobromide or silver chloride, which substantially does not contain iodide. Such silver chlorobromide or silver chloride grains have an effect of shortening the development time. The term "substantially does not contain iodide" means that the iodide content is not more than 1 mol % (preferably not more than 0.2 mol %).

Silver iodide (0.01 to 3 mol %) may be introduced into the surface of high chloride grains. Such a halide composition can be used to increase the sensitivity at a high intensity, to increase the spectral sensitivity or to improve the stability of the photographic material (as is described in Japanese Patent Provisional Publication No. 3(1991)-84545). The halide composition may differ in each of silver halide grains contained in an emulsion. The characteristics of the grains can easily be made uniform by using an emulsion having the same halide composition in each of the grains.

Silver halide grains have a homogeneous or heterogeneous structure with respect to distribution of silver halide composition in the grain. A homogeneous silver halide grain has the same halide composition at any portions of the grain. A heterogeneous grain has such a layered structure that an internal core is surrounded by an external shell, which may comprise two or more layers. Another heterogeneous grain has a portion of a specific halide composition in the grain or on the surface of the grain. The specific portion does not have the layered structure. In the case that the specific portion is present on the surface of the grain, the portion is fused with the edge, corner or face of the grain.

The heterogeneous grain is advantageously used to obtain a high sensitivity, compared with the homogeneous grain. The heterogeneous grain is rather resistant to pressure. The interface portion of the halide composition in the heterogeneous grain may have a loose interface, which forms mixed crystals with the different compositions. Further, a continuous change of the structure can be intentionally introduced into the interface.

In a high chloride silver halide emulsion, silver halide grains preferably have a layered or non-layered localized phase of silver bromide. The localized phase may be contained in the grain. The phase may also be present on the surface of the grain. The phase preferably has such a halide composition that silver bromide content is not less than 10 mol %. The silver bromide content is more preferably more than 20 mol %. The silver bromide content in the localized phase can be measure by a X-ray analysis (described in New Experimental Chemistry VI, Structure Analysis, Japan Chemical Society, Maruzen, written in Japanese). The localized phase can be introduced into the inside of the grain or the edge, corner or face on the surface of the grain. The phase is preferably formed on the corner of the grain according to an epitaxial formation.

The silver chloride content in the silver halide emulsion can be increased to reduce the amount of the replenishing developing solution. In such a case, a substantially pure silver chloride is preferably used. The silver chloride content is preferably in the range of 98 to 100 mol %.

The silver halide grains preferably have an average grain size in the range of 0.1 to 2 $\mu$m. The average grain size means an average of the diameter of a circle having an area, which corresponds to the projected area of each of the grains.

The grain size distribution preferably is monodispersed. In more detail, the distribution coefficient (=standard deviation of grain size distribution per average grain size) is preferably not more than 20%, more preferably not more than 15%, and most preferably not more than 10%.

A mixture of two or more monodispersed emulsions may be contained in one emulsion layer to obtain a broad latitude. Further, two or more monodispersed emulsions may form two or more layers to obtain a similar effect.

The silver halide grains may be of various crystal forms. Examples of the forms include a regular crystal form, an irregular form and a mixed form thereof. The regular crystal forms include hexahedron, tetradecahedron and octahedron. The irregular forms include spherical form and tabular form. In the present invention, at least 50% (more preferably 70%, and most preferably 90%) of the grains preferably have the above-mentioned regular crystal form.

The silver halide emulsion may contain tabular grains in an amount of 50% or more based on the projected area. The tabular grain usually has an aspect ratio (diameter per thickness) of 5 or more. The aspect ratio preferably is 8 or more.

A silver halide solvent can be used to form a monodispersed silver halide emulsion. Examples of the silver halide solvents include thiocyanate salts, thioethers, thioureas, thiones, amines, potassium rhodanide and ammonium rhodanide. Thiocyanate salts, thioethers, thioureas are preferred. Ammonia may be used in combination with another solvent so long as a harmful effect is not caused.

The thiocyanates are disclosed in U.S. Pat. Nos. 2,222,264, 2,448,534 and 3,320,069. The thioether compounds are disclosed in U.S. Pat. Nos. 3,271,157, 3,574,628, 3,704,130, 4,276,347 and 4,297,439. The thiones are disclosed in Japanese Patent Provisional Publication Nos. 53(1978)-82408, 53(1978)-144319 and 55(1980)-77737. The amines are disclosed in Japanese Patent Provisional Publication No. 54(1979)-100717.

The silver halide emulsion can be prepared according to a conventional process. The emulsion is generally prepared by adding aqueous solutions of a silver salt and a halide salt to an aqueous solution of gelatin in a reaction vessel while effectively stirring them. The process for preparation of the emulsion is described in P. Glafkides, Chemie et Phisique Photographique (Paul Montel, 1967), G. F. Duffin, Photographic Emulsion Chemistry (The Focal Press, 1966), V. L. Zelikman et al, Making and Coating Photographic Emulsion (The Focal Press, 1964). Any of the acid method, the neutral method and the ammonia method is available for preparation of the emulsion. Further, a one-side mixing method, a simultaneous mixing method and a combination thereof are available with respect to a reaction of a soluble silver salt with a soluble halogen salt.

A controlled double jet process (a kind of the simultaneous mixing method) is also available. In the controlled double jet process, the pAg value of the reaction solution (in which silver halide is formed) is controlled at a constant value.

The rates of adding silver nitrate and alkaline halide can be varied according to the rate of crystal growth, as is disclosed in British Patent No. 1,535,016, Japanese Patent Publication Nos. 43(1968)-36890 and 52(1977)-16364. The concentration of the aqueous solution can also be controlled, as is disclosed in U.S. Pat. No. 4,242,445 and Japanese Patent Provisional Publication No. 55(1980)-158124. These processes are preferably used because re-nucleation of the silver halide does not occur and the grains are homogeneously grown.

The above-mentioned silver halide solvent can be used to control the growth of the silver halide grains at the step of grain formation.

A process of grain formation or physical ripening can be conducted in the presence of cadmium salt, zinc salt, thallium salt, iron salt or a complex thereof, ruthenium salt or a complex thereof, osmium salt or a complex thereof, cobalt salt or a complex thereof, rhodium salt or a complex thereof, or iridium salt or a complex thereof.

The gains in the emulsion may have a so-called core/shell double-layered structure (which consists of the core and the shell), triple-layered structure (disclosed in Japanese Patent Provisional Publication No. 60(1985)-222844) and multi-layered structure consisting of more than three layers. In addition to the layered structures, the grains may have a fused structure, which is disclosed in Japanese Patent Provisional Publications No. 58(1983)-108526 and No. 59(1984)-16254, No. 59(1984)-133540, Japanese Patent Publication No. 58(1983)-24772 and European Patent No. 199,290 A2.

To form a crystal of the fused structure, crystals having the composition different from that of the host crystals (i.e., the guest crystals) are fused at the edge, the corner or the face of the host crystal. Such fused crystals can be prepared whether the host crystal has homogeneous halogen composition or not.

The fused crystals may consist of a combination of a silver halide and a silver salt that does not have the rock salt structure (e.g., silver rhodanate, silver carbonate) as well as a combination of silver halides. A salt of non-silver salt such as PbO is also available in the fused structure.

Silver iodobromide grain of core/shell type may have such iodide distribution that silver iodide content in the core is higher than that in the shell. Further, the grain may have such a structure that silver iodide content in the shell is higher than that in the core. In the case of silver iodobromide grains of fused crystals, the silver iodide content in the host crystals may be higher than that in the guest crystal. The content in the guest crystal may also be higher than that in the host crystal.

In the above-described grains consisting of two or more portions in which compositions of silver halide are different each other, the portions can be separated with a vague border. Further, the composition may be gradually changed between the portions.

The silver halide emulsion may be so treated that the grains be rounded, as is described in European Patents No. 0,096,727B1 and No. 0,064,412B1. Further, the surface of the grains can be modified, as is described in German Patent No. 2,306,447C2 and Japanese Patent Provisional Publication No. 60(1985)-221320.

Silver halide grains may have a dislocation line, which is disclosed in U.S. Pat. No. 4,806,461.

Gelatin is usually used as a binder of the emulsion layer or an intermediate layer. Gelatin is also used as a protective colloid.

Other hydrophilic polymers are also available as the binder or the protective colloid. Examples of the other polymers include proteins (e.g., gelatin derivatives, graft polymers of gelatin with another polymer, albumin, casein), saccharide derivatives (e.g., cellulose derivatives, sodium alginate, starch derivatives) and a synthetic hydrophilic polymer (e.g., polyvinyl alcohol, a partial acetal of polyvinyl alcohol, poly-N-vinyl pyrrolidone, polyacrylic acid, polymethacrylic acid, polyacrylamide, polyvinyl imidazole, polyvinyl pyrazole, a copolymer thereof). Examples of the cellulose derivatives include hydroxyethyl cellulose, carboxymethyl cellulose and cellulose sulfate.

A lime-treated gelatin is frequently used in preparation of a silver halide emulsion. Further, an acid-treated gelatin and an enzyme-treated gelatin are available. The enzyme-treated gelatin is described in Bul. Soc. Phot. Japan, volume 16, page 30 (1966). A hydrolyzed gelatin is also available.

An inorganic or organic hardening agent can be added to a hydrophilic colloidal layer such as a photographic layer or a backing layer. Examples of the hardening agent include chromium salts, aldehyde salts, N-methylol compounds, active halogen compounds, active vinyl compounds, N-carbamoylpyridinium salts and haloamidinium salts. Active halogen compounds, active vinyl compounds, N-carbamoylpyridinium salts and haloamidinium salts are preferred because they quickly harden the colloidal layer. Active halogen compounds and active vinyl compounds are further preferred because they remarkably stabilize the photographic properties.

Examples of the aldehydes in the aldehyde salts include formaldehyde, glyoxal and glutaraldehyde. An example of the N-methylol compound is dimethylol urea. Examples of the active halogen compounds include 2,4-dichloro-6-hydroxy-1,3,5-triazine and its sodium salt. Examples of the active vinyl compounds include 1,3-bisvinylsulfonyl-2-propanol, 1,2-bis(vinylsulfonylacetamide)ethane, bis(vinylsulfonylmethyl)ether and a vinyl polymer having vinylsulfonyl group at the side chain. An example of the N-carbamoylpyridinium salt is 1-morpholinocarbonyl-3-pyridinio)methanesulfonate. An example of the haloamidinium salt is 1-(1-chloro-1-pyridinomethylene) pyrrolidinium-2-naphthalenesulfonate.

The silver halide emulsion is generally subjected to a spectral sensitization. Examples of spectral sensitizing dyes include methine dyes, cyanine dyes, merocyanine dyes, complex cyanine dyes, complex merocyanine dyes, holopolar cyanine dyes, hemicyanine dyes, styryl dyes and hemioxonol dyes. Cyanine dyes, merocyanine dyes and complex merocyanine dyes are particularly preferred. The dyes may have a basic heterocyclic ring, which is usually contained in the cyanine dyes. Examples of the heterocyclic rings include pyrroline ring, oxazoline ring, thiazoline ring, selenazoline ring, pyrrole ring, oxazole ring, thiazole ring, selenazole ring, imidazole ring, tetrazole ring, pyridine ring and tellurazole ring. The heterocyclic ring may be condensed with an alicyclic hydrocarbon ring or an aromatic hydrocarbon ring. Examples of the condensed rings include indolenine ring, benzindolenine ring, indole ring, benzoxazole ring, naphthoxazole ring, benzimidazole ring, naphthimidazole ring, benzthiazole ring, naphthothiazole ring, benzoselenazole ring, naphthoselenazole ring and quinoline ring. The heterocyclic ring of the dye may have a substituent group on its carbon atom.

Merocyanine dyes and complex merocyanine dyes have a ring of a ketomethylene structure. The rings of the ketomethylene structure preferably are 5- or 6-membered heterocyclic rings such as pyrazoline-5-one ring, thiohydantoin ring, 2-thiooxazolidine-2,4-dione ring, thiazolidine-2,4-dione ring, rhodanine ring and thiobarbituric acid ring.

Two or more sensitizing dyes can be used in combination. The combinations of dyes are sometimes used for supersensitization. The sensitizing dye may be also used in combination with a supersensitizer, which themselves cannot spectrally sensitize the emulsions or cannot absorb visible light. Examples of the supersensitizers include aminostil compounds substituted with nitrogen-containing heterocyclic groups (disclosed in U.S. Pat. Nos. 2,933,390 and 3,365,721), condensed compounds of aromatic acids with formaldehydes (described in U.S. Pat. No. 3,743,510), cadmium salts and azaindene compounds. The combinations of the sensitizing dye with the supersensitizers are described in U.S. Pat. Nos. 3,615,613, 3,615,641 and 3,635,721.

The silver halide emulsion is usually chemically sensitized. Examples of the chemical sensitizations include sulfur sensitization, selenium sensitization, tellurium sensitization, noble metal sensitization, reduction sensitization and a combination thereof.

Sulfur sensitization is carried out using a labile sulfur compound as a sulfur sensitizer. The sulfur sensitization is disclosed in P. Glafkides, Chemie et Phisique Photographique (Paul Montel, 1970); Research Disclosure, volume 307, No. 307105; T. H. James, The Theory of the Photographic Process, fourth edition (Macmillan, 1977); and H. Frieser, Die Grundlagender Photographischen Prosess mit Silver-halogeniden (Akademische Verlagsgeselbshaft, 1968).

Examples of sulfur sensitizers include thiosulfates (e.g., sodium thiosulfate, p-toluene thiosulfonate), thioureas (e.g., allylthiourea, N,N'-diphenylthiourea, triethylthiourea, triethylthiourea, acetylthiourea, N-ethyl-N'-(4-methyl-2-thiazolyl)thiourea), thioamides (e.g., thioacetamide, N-phenylthioamide), rhodanines (e.g., rhodanine, N-ethylrhodanine, 5-benzylidenerhodanin, 5-benzylidene-N-ethyl-rhodanine, diethylrhodanine), thiohydantoins, 4-oxo-oxazolidine-2-thiones, disulfides or polysulfides, thiosulfinic acids, mercapto compounds (e.g., cysteine), polythionic acid salts, simple body of sulfur and sodium sulfide. Thiosulfate, thioureas, thioamides and rhodanines are generally used.

Selenium sensitization is carried out using a labile selenium compound as a selenium sensitizer. The selenium sensitization is disclosed in Japanese Patent Publication Nos. 43(1968)-13489 and 44(1969)-15748, Japanese Patent Provisional Publication Nos. 4(1992)-25832, 4(1992)-40324, 4(1992)-109240, 4(1992)-147250 and 4(1992)-271341.

Examples of the selenium sensitizers include selenoureas (e.g., selenourea, N,N-dimethylselenourea, N,N-diethylselenourea, tetramethylselenourea, N,N,N'-trimethyl-N'-acetylselenourea, N,N,N'-trimethyl-N'-heptafluoropropylcarbonylselenourea, N,N,N'-trimethyl-N'-4-chlorophenylcarbonylselenourea, N,N,N'-trimethyl-N'-4-nitrophenylcarbonylselenourea), selenamides (e.g., selenacetamide, N,N-diethylselenobenzamide), selenoketones (e.g., selenoacetone, selenoacetophenone, bis-(adamantyl)selenoketone), isoselenocyanates (e.g., allylisoselenocyanate), selenocarboxylic acids and esters thereof (e.g., selenopropyonic acid, methyl-3-selenobutyrate), selenides (e.g., dimethylselenide, diethylselenide, triphenylphosphineselenide), selenophosphates (e.g., tri-p-tolylselenophosphate and colloidal metal selenium.

Tellurium sensitization is disclosed in U.S. Pat. Nos. 1,623,499, 3,320,069 and 3,772,031, British Patent Nos. 235,211, 1,121,496, 1,295,462 and 1,396,696, Canadian Patent No. 800,958, J. Chem. Soc., Chem. Commun., 635 (1980), 1102 (1979), 645 (1979), J. Chem. Soc., Perkin. Trans., 1, 2191 (1980), and Japanese Patent Provisional Publication Nos. 4(1992)-204640 and 4(1992)-333043.

Examples of the tellurium sensitizers include colloidal tellurium, telluroureas (e.g., allyltellurourea, N,N-dimethyltellurourea, tetramethyltellurourea, N-carboxyethyl-N',N'-dimethyltellurourea, N,N'-dimethylethylenetellurourea and N,N'-diphenylethylenetellurourea), isotellurocyanates (e.g., allylisotellurocyanate), telluroketones (e.g., telluroacetone, telluroacetophenone), telluroamides (e.g., telluroacetoamide, N,N-dimethyltellurobenzamide), tellurohydrazides (e.g., N,N',N'-trimethyltellurobenzhydrazide), telluroesters (e.g., t-butyl-t-hexyltelluroester), phosphinetellurides (e.g., tributoxyphosphinetelluride, tricyclohexylphosphinetelluride, triisopropylphosphinetelluride, butyldiisopropylphosphinetelluride, dibutylphenylphinetelluride), gelatin containing telluride anion (disclosed in British Patent No. 1,295,462), potassium telluride, potassium tellurocyanate, sodium telluropentathionate and allyl tellurocyanate.

Noble metal sensitization is carried out using a noble metal (e.g., gold, platinum, palladium, iridium) compound as a selenium sensitizer. The noble metal sensitization is disclosed in P. Glafkides, Chemie et Phisique Photographique (Paul Montel, 1970) and Research Disclosure, No. 307105. A gold sensitization is preferably used. Examples of the gold sensitizers include chloroauric acid, potassium chloroaurate, potassium aurithiocyanate, gold sulfide and gold selenide and gold compounds. The gold sensitizers are described in U.S. Pat. Nos. 2,642,361, 5,049,484 and 5,049,485.

Reduction sensitization is carried out using known reducing compounds, which are disclosed in "Chemie et Phisique Photographique (Paul Montel, 1970)" written by P. Glafkides and Research Disclosure, volume 307, No. 307105. Examples of the reducing compounds include aminoiminomethanesulfinic acid (i.e., thiourea dioxide), borane compounds (e.g., dimethylaminoborane), hydrazine compounds (e.g., hydrazine, p-tolylhydrazine), polyamine compounds (e.g., diethylenetriamine, triethylenetetramine), tin (II) chloride, silane compounds, reductones (e.g., ascorbic acid), sulfites, aldehydes and hydrogen gas.

Two or more chemical sensitizations can be carried out in combination with the gold sensitization. A combination of a chalcogen (sulfur, selenium, tellurium) sensitization with a gold sensitization is particularly preferred. The reduction sensitization is preferably carried out while forming silver halide grains.

The amount of the chalcogen sensitizer is preferably in the range of $10^{-8}$ to $10^{-2}$ mol, and more preferably in the range of $10^{-7}$ to $5\times10^{-3}$ mol based on 1 mol of silver.

The amount of the noble metal sensitizer is preferably in the range of $10^{-7}$ to $10^{-2}$ mol based on 1 mol of silver.

With respect to the condition of chemical sensitization, the pAg value is preferably in the range of 6 to 11, and more preferably in the range of 7 to 10. The pH value is preferably in the range of 4 to 10. The temperature is preferably in the range of 40 to 95° C., and more preferably in the range of 45 to 85° C.

The photographic emulsion may contain various additives such as stabilizer and anti-fogging agent to stabilize the photographic properties of the photographic material or to inhibit the fog at the processes for preparing, storing or treating the photographic material. Examples of the additives include azoles (e.g., benzothiazolium salts, nitroindazoles, nitrobenzimidazoles, chlorobenzimidazoles), mercaptopyrimidines, mercaptotriazines, thioketo compounds (e.g., oxazolinethione), azaindenes (e.g., triazaindenes, pentazaindenes), benzenethiosulfonic acids, benzenethiosulfinic acids and benzenesulfonamides.

The photographic material may further contain a surface active agent, which is used as a coating aid, an anti-static agent, a slipping agent, an emulsifying or dispersing agent, an anti adhesion agent and an agent for improving photographic properties (for example, accelerating development, hardening gradation or sensitization).

In addition to the cyano-chromium-complex ion of the present invention, silver halide grains may further contain a complex of the other metals such as iron, ruthenium, osmium, cobalt, rhodium and iridium. Two or more complexes can be used in combination with the cyano-chromium-complex ion.

The amount of the metal complex is preferably in the range of $10^{-9}$ to $10^{-2}$ mol, and more preferably in the range of $10^{-8}$ to $10^{-4}$ mol based on 1 mol of silver halide.

The complex of iron, ruthenium, osmium, cobalt, rhodium or iridium is used in preparation of silver halide grains (before or after nuclei formation, grain growth, physical ripening or chemical sensitization). The addition of the metal complex can be conducted a few times in preparation of the silver halide emulsion. The metal compounds can be used in the form of a solution in water or an organic solvent. The organic solvent is preferably miscible with water. Examples of the organic solvents include alcohols, ethers, glycols, ketones, esters and amides.

An iridium complex is preferably used in combination with the cyano-chromium-complex ion. The iridium complex preferably has three or four valences. Examples of the iridium complexes include hexachloroiridium(III) complex salt, hexachloroiridium(VI) complex salt, hexabromoiridium(III) complex salt, hexabromoiridium(IV) complex salt, hexaiodoiridium(III) complex salt, hexaiodoiridium(IV) complex salt, hexammineiridium(III) complex salt and hexammineiridium (IV) complex salt.

The counter cation of the iridium complex is preferably soluble in water. The cation is also preferably appropriate for procedures of precipitating the silver halide emulsion. Examples of the counter cations include an alkali metal ion (e.g., sodium ion, potassium ion, rubidium ion, cesium ion, lithium ion), ammonium ion and alkylammonium ion. The alkylammonium ion is described in the formula (II).

The amount of the iridium complex (except the below-mentioned hexa-coordinated cyano-iridium-complex) is preferably in the range of $10^{-9}$ to $10^{-4}$ mol, and more preferably in the range of $10^{-8}$ to $10^{-5}$ mol based on 1 mol of silver halide.

A hexa-coordinated cyano-metal-complex represented by the following formula (VII) is most preferably used in combination with the cyano-chromium-complex ion. The hexa-coordinated cyano-metal-complex has an effect of increasing the sensitivity of the photographic material. Further, the occurrence of fog is reduced by the complex even after the material is preserved for a long term.

$$[M(CN)_6]^{n-} \quad \text{(VII)}$$

In the formula (VII), M is iron, ruthenium, osmium, cobalt, rhodium or iridium; and n is 3 or 4.

Examples of the hexa-coordinated cyano-metal-complexes are shown below.

$$[Fe(CN)_6]^{4-} \quad \text{(VII-1)}$$

$$[Fe(CN)_6]^{3-} \quad \text{(VII-2)}$$

$$[Ru(CN)_6]^{4-} \quad \text{(VII-3)}$$

$$[Os(CN)_6]^{4-} \quad \text{(VII-4)}$$

$$[Co(CN)_6]^{3-} \quad \text{(VII-5)}$$

$$[Rh(CN)_6]^{3-} \quad \text{(VII-6)}$$

$$[Ir(CN)_6]^{3-} \quad \text{(VII-7)}$$

The counter cation of the hexa-coordinated cyano-metal-complex is preferably soluble in water. The cation is also preferably appropriate for procedures of precipitating the silver halide emulsion. Examples of the counter cations include an alkali metal ion (e.g., sodium ion, potassium ion, rubidium ion, cesium ion, lithium ion), ammonium ion and alkylammonium ion. The alkylammonium ion is described in the formula (II).

The amount of the hexa-coordinated cyano-metal-complex is preferably in the range of $10^{-6}$ to $10^{-3}$ mol, and more preferably in the range of $5\times10^{-6}$ to $5\times10^{-4}$ mol based on 1 mol of silver halide.

The hexa-coordinated cyano-metal-complex is used in preparation of silver halide grains (before or after nuclei formation, grain growth, physical ripening or chemical sensitization). The addition of the complex can be conducted a few times in preparation of the silver halide emulsion.

At least 50% of the hexa-coordinated cyano-metal-complex is preferably introduced into the surface phase of the grains. The surface phase means that the surface portion having a volume of not more than 50% in the silver halide grains. The volume of the surface phase is more preferably not more than 40%, and most preferably not more than 20%. On the surface phase defined above, the grain may have another layer that does not contain the hexa-coordinated cyano-metal-complex.

The hexa-coordinated cyano-metal-complex can be used in the form of a solution in water or an organic solvent. The organic solvent is preferably miscible with water. Examples of the organic solvents include alcohols, ethers, glycols, ketones, esters and amides. The solution can be directly added to a reaction solution at the stage of silver halide grain formation. The solution can also be added to solutions for silver halide grain formation (e.g., an aqueous halide solution, an aqueous silver solution) before the formation. Further, silver halide grains containing the metal complex may be dissolved and added to other silver halide grains. Thus the dissolved grains are deposited on the other grains to introduce the metal complex into the grains.

The silver halide photographic material preferably has a surface pH value in the range of 4.0 to 6.5, and more preferably in the range of 5.0 to 6.5.

The surface pH value is determined by the whole layers provided on the support. Therefore, the surface pH value should not correspond to the pH value in the coating solution of each of the layers. The surface pH value is measured according to a process comprising:

(1) dropping 0.05 ml of pure water on the surface (side of silver halide emulsion layer) of the photographic material; and (2) after leaving the material for 3 minutes, measuring pH value using an electrode for measuring the surface pH value (GS-165, Toa Denpa K.K.).

The above-mentioned process is described in Japanese Patent Provisional Publication No. 61(1986)-245153.

The surface pH value can be adjusted by using an acid (e.g., sulfuric acid, citric acid) or an alkali (e.g., sodium hydroxide, potassium hydroxide). There is no specific limitation with respect to the method for addition of the acid or the alkali. The acid and alkali most easily added at the stage of preparation of a coating solution of a layer. The acid and alkali can be added to a part of the photographic layers.

A hydrophilic layer of the photographic material may contain a dye that can be decolored. Such a dye can be used to prevent halation and irradiation. Further, the dye may be used to decrease the sensitivity to a safelight. European Patent No. 337490A2 at pages 27 to 76 discloses dyes that can be decolored, such as oxonol dyes and cyanine dyes.

A solid particle dispersion of a dye can be added to a hydrophilic layer. The dye can be decolored at a development process. Such a dye is described in Japanese Patent Provisional Publication Nos. 2(1990)-282244 at pages 3 to 8 and 3(1991)-7931 at pages 3 to 11.

Other dyes can also be added to the photographic material. Examples of the other dyes include hemioxonol dyes, styryl dyes, merocyanine dyes, anthraquinone dyes, an azo dye, a cyanine dye, an azomethine dye, a triarylmethane dye and a phthalocyanine dye. Further, an oil-soluble dye can be also added to the hydrophilic colloidal layer by emulsifying the dye in water.

The dye preferably has such an absorption that the maximum absorption corresponds to the spectral sensitivity of a layer sensitive to the longest wave. Where the optical density (logarithm of reciprocal value of transparent light, corresponding to the reflection density on a reflective support) can be adjusted by the above-mentioned dyes to 0.5 or more, the sharpness of the image can be improved. The optical density is measured at 680 nm or at a wavelength of a laser beam for exposure.

The photographic material of the present invention can be used as a multi-layered multicolor photographic material, which comprises a support and two or more silver halide emulsion layers that have different spectral sensitivities.

The multi-layered natural color photographic material generally comprises at least one red-sensitive emulsion layer, at least one green-sensitive emulsion layer and at least one blue-sensitive emulsion layer on the support. The arrangement of those layers can optionally be determined. Preferably, the red-sensitive layer, the green-sensitive layer and the blue-sensitive layer are arranged from the support in the order. The blue-sensitive layer, the green-sensitive layer and the red-sensitive layer can be arranged in the order from the support. The blue-sensitive layer, the red-sensitive layer and the green-sensitive layer can also be arranged in the order from the support. Further, two or more emulsion layers that are sensitive to the same color but show different sensitivities can be provided to enhance the sensitivity. Three emulsion layers can be provided to improve the graininess of the image. A non-light sensitive layer may be provided between two or more emulsion layers having the same color sensitivity. Otherwise, another emulsion layer having a different color sensitivity can be provided between two or more emulsion layers having the same color sensitivity. A light-reflecting layer such as a layer of silver halide grains can be provided under a high sensitive layer, particularly under a high blue-sensitive layer, to enhance the sensitivity.

The red-sensitive emulsion layer generally contains a cyan coupler, the green-sensitive emulsion layer generally contains a magenta coupler, and the blue-sensitive emulsion layer generally contains a yellow coupler. However, other combinations are also available. For example, an infrared sensitive layer can be used to prepare a false color film or a film for exposure to a semiconductor laser beam.

Various color couplers can be used for the photographic material of the invention. The color couplers are described in the patents cited in Research Disclosure No. 17643, VII C-G.

Yellow couplers are described in U.S. Pat. Nos. 3,933,501, 4,022,620, 4,326,024 and 4,401,752, Japanese Patent Publication No. 58(1983)-10739, and British Patent Nos. 1,425,020 and 1,476,760.

Preferred magenta couplers are 5-pyrazolone type and pyrazoloazole type compounds. The magenta couplers are described in U.S. Pat. Nos. 3,061,432, 3,725,067, 4,310,619, 4,351,897, 4,500,630 and 4,540,654, European Patent No. 73,636, Research Disclosure No. 24220 (June 1984) and No. 24230 (June 1984), Japanese Patent Provisional Publication Nos. 60(1985)-33552, 60(1985)-43659.

Preferred cyan couplers are phenol type and naphthol type couplers. The cyan couplers are described in U.S. Pat. Nos. 2,369,929, 2,772,162, 2,801,171, 2,895,826, 3,446,622, 3,758,308, 3,772,002, 4,052,212, 4,146,396, 4,228,233, 4,296,200, 4,327,173, 4,333,999, 4,334,011, 4,427,767 and 4,451,559, German Patent Publication No. 3,329,729, European Patent Nos. 121,365A and 161,626A.

A colored coupler may be used to correct unnecessary absorption of a formed dye. The colored couplers are described in Research Disclosure No. 17643, VII-G, U.S. Pat. Nos. 4,004,929, 4,138,258, 4,163,670, British Patent No. 1,146,368, Japanese Patent Publication No. 57(1982)-39413, The photographic material can contain a coupler that gives a developed color dye having an appropriate diffusion property. Such couplers are described in U.S. Pat. No. 4,366,237. British Patent No. 2,125,570, European Patent No. 96,570 and German Patent Publication No. 3,234,533.

A polymerized dye-forming coupler is also available. The dye-forming couplers are described in U.S. Pat. Nos. 3,451,820, 4,080,211 and 4,367,282 and British Patent No. 2,102,173.

The photographic material can contain a coupler that releases a photographic functional residue according to a coupling reaction. For example, a DIR coupler releases a development inhibitor. The DIR couplers are described in Research Disclosure No. 17643, VII-F, Japanese Patent Provisional Publication Nos. 57(1982)-151944, 57(1982)-154234 and 60(1985)-184248, and U.S. Pat. No. 4,248,962.

The photographic material can also contain a coupler that imagewise releases a nucleating agent or a development accelerator in a development process. Such couplers are described in British Patent Nos. 2,097,140 and 2,131,188, and Japanese Patent Provisional Publication Nos. 59(1984)-157638 and 59(1984)-170840.

Examples of other couplers include a competitive coupler, a polyvalent coupler, a DIR redox compound, a DIR coupler releasing coupler, a dye releasing coupler, a bleach accelerator releasing coupler and a ligand releasing coupler. The competitive coupler is described in U.S. Pat. No. 4,130,427. The polyvalent coupler is described in U.S. Pat. Nos. 4,283,472, 4,338,393 and 4,310,618. The DIR redox compounds and the DIR coupler releasing couplers are described in Japanese Patent Provisional Publication Nos. 60(1985)-185950 and 62(1987)-24252. The dye releasing coupler releases a dye, which is restored to original color. The dye releasing coupler is described in European Patent No. 173,302A. The bleach accelerator releasing coupler is described in Research Disclosure No. 11449, ibid. No. 24241, and Japanese Patent Provisional Publication No. 61(1986)-201247. The ligand releasing coupler is described in U.S. Pat. No. 4,553,477.

The couplers can be introduced into the photographic material by various known dispersing methods. A high-boiling solvent can be used in an oil in water dispersing method. The high-boiling solvents are described in U.S. Pat. No. 2,322,027.

The high-boiling organic solvents usually have a boiling point of not lower than 175° C. under a normal pressure. Examples of the high-boiling organic solvents include phthalic esters, phosphoric esters, phosphonic esters, benzoic esters, amides, alcohols, phenols, aliphatic carboxylic esters, aniline derivatives and hydrocarbons.

Examples of the phthalic esters include dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate and bis(1,1-diethylpropyl) phthalate. Examples of the phosphoric esters include triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate and di-2-ethylhexyl phosphate. Examples of the benzoic esters include 2-ethylhexyl benzoate, dodecyl benzoate and 2-ethylhexyl-p-hydroxybenzoate. Examples of the amides include N,N-diethyldodecanamide, N,N-diethyllaurylamide and N-tetradecylpyrrolidone. An example of the alcohol is isostearyl alcohol. An example of the phenol is 2,4-di-tert-amylphenol. Examples of the aliphatic carboxylic esters include bis(2-ethylhexyl)sebacate, dioctyl azelate, glycerol tributyrate, isostearyl lactate and trioctyl citrate. An example of the aniline derivative is N,N-dibutyl-2-butoxy-5-tert-octylaniline. Examples of the hydrocarbons include paraffin, dodecylbenzene and diisopropylnaphthalene.

An organic solvent can be used as an auxiliary solvent in addition to the high-boiling organic solvent. The auxiliary solvent has a boiling point of not lower than 30° C. The boiling point preferably is in the range of 50 to 160° C. Examples of the auxiliary solvents include ethyl acetate, butyl acetate, ethyl propionate, methyl ethyl ketone, cyclohexanone, 2-ethoxyethyl acetate and dimethylformamide.

The coupler can also be added to the photographic material according to a latex dispersing method. A process of the latex dispersing method, effects thereof and examples of latex for impregnation are described in U.S. Pat. No. 4,199,363, German Patent Publication Nos. 2,541,274 and 2,541,230.

A color image stabilizing compound can be used in combination with the coupler. The color image stabilizing compound is described in European Patent No. 277,589A2. The color image stabilizing compound is preferably used in combination with pyrazoloazole couplers or pyrrolotriazole couplers. The compound chemically binds to a remaining aromatic amine developing agent after a color development process to form a chemically inert and substantially colorless compound. Alternatively, the compound chemically binds to a remaining oxidation product of the aromatic amine developing agent to form a chemically inert and substantially colorless compound. Thus, the compound inhibits the occurrence of stain caused by a dye, which is formed by a reaction of the remaining color developing agent or the oxidation product thereof with a coupler after the treatment.

The photographic material can contain a mildewcide, which prevents the propagation of mildew or bacteria in a colloidal layer. The mildew and bacteria degrades the formed image. The mildewcide is described in Japanese Patent Provisional Publication No. 63(1988)-271247.

The above-mentioned photographic layers are coated on a support. Various flexible and rigid materials can be used as the support. The flexible materials include plastic films, papers and cloths. The rigid materials include glass, ceramics and metals. Preferred examples of the flexible materials include semi-synthetic or synthetic polymers, baryta papers; and other papers coated or laminated with α-olefin polymers. Examples of the semi-synthetic or synthetic polymers include cellulose nitrate, cellulose acetate, cellulose acetate butyrate, polystyrene, polyvinyl chloride, polyethylene terephthalate and polycarbonate. Examples of the α-olefin polymers include polyethylene, polypropylene and ethylene-butene copolymer. The support can be colored with dyes or pigments. Further, the support can also be made black for light-blocking. The surface of the support is generally subjected to undercoating treatment to enhance the adhesion with the silver halide emulsion layer. The surface of the support may be further subjected to other various treatments such as glow discharge, corona discharge, irradiation with ultraviolet rays and flame treatment before or after the undercoating treatment.

The silver halide emulsion layer and other hydrophilic colloidal layers can be coated on the support by a known coating method such as dip coating, roller coating, flood coating and extrusion coating. Two or more layers can be simultaneously coated. The simultaneous coating methods are described in U.S. Pat. Nos. 2,681,294, 2,761,791 3,508,947 and 3,526,528.

The photographic material of the invention can be used as a color photographic material. In more detail, the photographic material is available as a usual or cinematographic color negative film, a color reversal film for slide or television, a color paper, a color positive film, a color reversal paper, a color diffusion transfer light-sensitive material and heat-developable color light-sensitive material.

The photographic material of the present invention is also available as a black and white photographic material such as a X-ray film. A black image can be formed by using a mixture of three color couplers or by using a black coupler. A method of mixing three color couplers are described in Research Disclosure, No. 17,123, (July 1978). The black coupler is described in U.S. Pat. No. 4,126,461 and British Patent No. 2,102,136.

Furthermore, the photographic material is available as a printing film (e.g., lithographic films and scanner films), a medical (direct or indirect) or industrial X-ray film, a picture-taking black and white negative film, a black and white photographic paper or a COM or usual micro-film. Moreover, the material is available as a silver salt diffusion transfer type photographic material or a printing out type photographic material.

The photographic material can be used in a color diffusion transfer process. The color diffusion transfer process can be classified into a peel apart type, an integrated type and a film unit type that does not require peeling. The integrated type is described Japanese Patent Publication Nos. 46(1971)-16356 and 48(1973)-33697, Japanese Patent Provisional Publication No. 50(1975)-13040, and British Patent No. 1,330,524. The film unit type is described in Japanese Patent Provisional Publication No. 57(1982)-19345.

An acidic polymer layer protected with a neutralization timing layer can be advantageously used in the color diffusion transfer photographic material, because the layers have a function of allowing a broad latitude of the processing temperature. The acidic polymer may be added to a developing solution contained in a vessel.

Various exposure means can be employed for exposure of the photographic material of the invention. As the light source, any optional light source releasing a radiation corresponding to the sensitivity wavelength of the photographic material can be employed. Examples of the light sources generally used include natural light (sun light), incandescent lamp, halogen lamp, mercury lamp, fluorescent lamp, and flash light sources (e.g., electric flash and metal-burning flashbulb).

Light sources that emit light in the ultraviolet to infrared region can be also used as the recording light sources. For example, the photographic material can be exposed to gas lasers, dye solution lasers, semiconductor lasers, light emission diode or plasma light source. The material can be exposed to fluorescent surface given by the stimulated phosphor with electron rays (e.g., CRT). A liquid crystal (LCD) is also available. The photographic material can use an exposure means in a microshutter array is combined with a linear or plane-like light source. The microshutter array may comprise lead zirconate titanate (PLZT) doped with lanthanum. The spectral distribution used in the exposure process can be appropriately adjusted by color filters.

A color developing solution used in the development process of the photographic material preferably is an alkaline aqueous solution containing an aromatic primary amine color developing agent as a host component. Aminophenol compounds and p-phenylenediamine compounds are preferably used as the color developing agent. Examples of the p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamideethylaniline and 3-methyl-4-amino-N-ethyl-N-β-methoxyethylaniline. Sulfates, hydrochlorides and p-toluenesulfonates of those compounds are also available. Salts of diamines are generally preferred to free diamines because the salts are more stable than the free diamines.

The color developing solution generally contains pH buffering agents (e.g., alkali metal carbonates, borates and phosphates), development inhibitors (e.g., bromides, iodides, benzimidazoles, benzothiazoles, mercapto compounds) and antifogging agents. The developing solution may further contain preservatives (e.g., hydroxylamine, sulfite), organic solvents (e.g., triethanol amine, diethylene glycol), development accelerators (e.g., benzyl alcohol, polyethylene glycol, quarternary ammonium salts, amines), nucleus-forming agents (e.g., color-forming couplers, completing couplers and sodiumboron hydrides), development-assisting agents (e.g., 1-phenyl-3-pyrazolidone), viscosity-increasing agents, chelating agents (e.g., aminopolycarboxylic acid, aminopolyphosphonic acid, alkylphosphonic acid, phosphonocarboxylic acid) and antioxidants. The antioxidants are described in German Patent Publication No. 2,622,950.

In the development process of color reversal photographic materials, a color development is generally made after monochromatic development. A monochromic developing solution used in the monochromatic development generally contains various monochromatic developing agents such as dihydroxybenzenes (e.g., hydroquinone), 3-pyrazolidones (e.g., 1-phenyl-3-pyrazolidone), and aminophenols (e.g., N-methyl-p-aminophenol). The monochromatic developing agents can be employed singly or in combination.

The silver halide emulsion layer is generally subjected to bleaching process after the color development process. The bleaching process can be conducted simultaneously with or separately from a fixing process. For the rapid processing, a bleach-fix process can be conducted after the bleaching process. Bleaching solutions usually contain polyvalent metals such as iron(III), cobalt(III), chromium(IV) and copper (II), peracids, quinones and nitroso compounds. Examples of the bleaching agents include ferricyanides; dichromates; organic complex salts of iron(III) or cobalt(III), persulfates, manganates and nitrosophenol. Examples of the organic complex salts of iron(III) or cobalt(III) include complex salts thereof with aminopolycarboxylic acids and complex salts thereof with organic acids. Examples of the aminopolycarboxylic acids include ethylenediaminetetraacetic acid, diethylenetriaminepentaacetic acid, nitrilotriacetic acid and 1,3-diamino-2-propanoltetraacetic acid. Examples of the organic acids include citric acid, tartaric acid and malic acid. Ethylenediaminetetraacetic acid iron(III) salt, diethylenetriaminepentaacetic acid iron(III) salt and persulfate are preferred from the viewpoints of rapid processing and prevention of environmental pollution. Particularly, the ethylenediaminetetraacetic acid iron(III) complex salt is preferably used in a bleaching solution (in bleaching bath) or a bleach-fix solution.

A bleaching accelerator can be optionally used in the bleaching bath, the bleach-fix bath or the prior bath to those baths. Examples of the bleaching accelerators include mercapto or disulfide compounds, thiazolidine derivatives, thiourea derivatives, iodides, polyethylene oxides and polyamine compounds.

The mercapto and disulfide compounds are described in U.S. Pat. No. 3,893,858, German Patent Nos. 1,290,812, 2,059,988, Japanese Patent Provisional Publication No. 53(1978)-32736, 53(1978)-57831, 53(1978)-37418, 53(1978)-65732, 53(1978)-72623, 53(1978)-95630, 53(1978)-95631, 53(1978)-104232, 53(1978)-124424, 53(1978)-141623, 53(1978)-28426, and Research Disclosure No. 17129 (July 1978). The thiazolidine derivatives are described in Japanese Patent Provisional Publication No. 50(1975)-140129. The thiourea derivatives are described in Japanese Patent Publication No. 45(1970)-8506, Japanese Patent Provisional Publications Nos. 52(1977)-20832, 53(1978)-32735 and U.S. Pat. No. 3,706,561. The iodides are described in German Patent No. 1,127,715 and Japanese Patent Provisional Publication No. 58(1983)-16235. The polyethylene oxides are described in German Patent Nos. 966,410 and 2,748,430. The polyamine compounds are described in Japanese Patent Publication No. 45(1970)-8836. Other bleaching accelerators are described in Japanese patent Provisional Publication Nos. 49(1974)-42434, 49(1974)-59644, 53(1978)-94927, 54(1979)35727, 55(1980)-26506 and 58(1983)-163940. Additionally, iodide ion and bromide ion can also be available as the bleaching accelerator. The bleaching accelerators preferably are mercapto or disulfide compounds because the compounds show high acceleration effects. The preferred compounds are described in U.S. Pat. Nos. 3,893,858, 4,552,834, German Patent Publication No. 1,290,812 and Japanese Patent Provisional Publication No. 53(1978)-95630.

The bleaching accelerators may be contained in the photographic material. The bleaching accelerators are particularly effective in the bleach-fix process of color photographic materials for picture-taking.

A fixing agent is used in a bleach-fix or fixing process. Examples of fixing agents include thiosulfates, thiocyanates, thioether compounds, thioureas, and iodides. When iodides are used as the fixing agents, they are used in a large amount. Of the above-mentioned compounds, thiosulfates are generally used. A preservative can be used in the bleach-fix solution or the fixing solution. Examples of the preservatives include sulfites, bisulfites and carbonylbisulfurous acid addition products.

After the bleach-fix process or the fixing process, the photographic material is generally subjected to washing and stabilization. In the washing stage or the stabilization stage, a variety of known compounds can be used for preventing precipitation and saving water. For example, a hard water softening agent can be used to prevent precipitation. Examples of the agents include inorganic phosphoric acids, aminopolycarboxylic acids, organic aminopolyphosphoric acids and organic phosphoric acids. The washing or stabilizing solution may further contain germicides, mildewcides or metal salts (e.g., magnesium salts, aluminum salts and bismuth salts) to prevent various bacteria, alga and mildew.

A surface active agent is also available for preventing drying strain or drying mark. Further, various hardeners for film-hardening can be used in the solution. Moreover, compounds described in L. E. West, Photographic Science And Engineering, Vol. 6, pages 344 to 359, (1955) can be also employed. Chelating agents and mildewcides are effectively added to the solution.

In the washing process, countercurrent washing using two or more baths is generally employed to save water. Instead of the washing process, a multi-stage countercurrent stabilizing process as described in Japanese Patent Provisional Publication No. 57(1982)-8543 can be used, and in this process, 2 to 9 countercurrent baths are required. The stabilizing baths may further contain various compounds to stabilize resulting images. For example, various buffering agents for adjusting pH value of the resulting films (for example, adjusting to pH of 3 to 9), and aldehydes (e.g., formalin) may be added. Concrete examples of the buffering agents include borates, metaborates, borax, phosphates, carbonates, potassium hydroxide, sodium hydroxide, ammonia water, monocarboxylic acids, dicarboxylic acids and polycarboxylic acids. They may be used in combination. Further, other additives are available. Examples of the other additives include chelating agents (e.g., inorganic phosphoric acids, aminopolycarboxylic acids, organic phosphoric acids, organic phosphonic acids, aminopolyphosphonic acids and phosphonocarboxylic acids), germicides (e.g., benzoisothiazolinone, isothiazolone, 4-thiazolinebenzimidazole, halogenated phenol, sulfanilamide and benzotriazole), surface active agents, brightening agents and hardeners. Two or more additives can be used in combination.

A pH adjusting agent can be added to treating solutions. Ammonium salts are preferably used as the agent. Examples of the ammonium salts include ammonium chloride, ammonium nitrate, ammonium sulfate, ammonium phosphate, ammonium sulfite and ammonium thiosulfate.

In the use of the color photographic material for picture-taking, washing and stabilization process of one stage generally made after fixing process can be replaced with the aforementioned stabilization process and the washing process (water-saving stage). In this case, formalin used in the stabilizing bath can be omitted when the used magenta coupler has two equivalent weights.

The time required for the washing and stabilizing process depends on the kind of the photographic material or the processing conditions. The time generally is in the range of 20 seconds to 10 minutes, preferably in the range of 20 seconds to 5 minutes.

The silver halide color photographic material can contain a color developing agent for simple and rapid processing. Precursors of the color developing agents are preferably used to be contained in the photographic material.

Examples of the precursors include indolenine compounds, Schiff's base type compounds, aldol compounds, metal complex salts, urethane compounds, and other salt type precursors. The indolenine compounds are described in U.S. Pat. No. 3,342,597. The Schiff's base type compounds are described in U.S. Pat. No. 3,342,599 and Research Disclosure, Nos. 14,850 and 15,159. The aldol compounds are described in Research Disclosure, No. 13,924. The metal complex salts are described in U.S. Pat. No. 3,719,492. The urethane compounds are described in Japanese Patent Provisional Publication No. 53(1978)-135628. The other salt type precursors are described in Japanese Patent Provisional Publication Nos. 56(1981)-6235, 56(1981)-16133, 56(1981)-54430, 56(1981)-59232, 56(1981)-67842, 56(1981)-81837, 56(1981)-83734, 56(1981)-83735, 56(1981)-83736, 56(1981)-89735, 56(1981)-106241, 54(1979)-107236, 57(1982)-97531 and 57(1982)-83565.

The silver halide color photographic material may contain 1-phenyl-3-pyrazolidones to accelerate color development. The 1-phenyl-3-pyrazolidones are described in Japanese Patent Provisional Publication Nos. 56(1981)-64339, 57(1982)-144547, 57(1982)-211147, 58(1983)-50532, 58(1983)-50533, 58(1983)-50534, 58(1983)-50535, 58(1983)-50536 and 58(1083)-115438.

The processing solutions are used at a temperature of 10 to 50° C. The temperature generally is in the range of 33 to 38° C. However, the temperature can be adjusted higher to accelerate the processing or to shorten the processing time. On the other hand, it can be adjusted lower to improve qualities of the resulting images or to enhance the stability of the solutions. Cobalt intensification or hydrogen peroxide intensification can be used to save the amount of silver. The cobalt intensification is described in German Patent Publication No. 2,226,770. The hydrogen peroxide intensification is described in U.S. Pat. No. 3,674,499.

The above-mentioned various baths may be equipped with a heater, a temperature sensor, a liquid level sensor, a circulating pump, a filter, a floating lid or a squeegee.

In the continuous processing, a replenisher can be used for each processing solution to prevent the solution composition from varying, whereby a uniform finish can be obtained. The replenisher can be used in an amount of not more than half the standard amount to reduce the cost.

When the photographic material is used as a color paper, the above-mentioned bleach-fix process is usually carried out. The photographic material is used as a picture taking color photographic material, the process is optionally carried out.

EXAMPLE 1

Emulsion A: cubic silver chloride emulsion

In 845 ml of an aqueous solution containing 4.5 g of sodium chloride, 25 g of deionized gelatin was dissolved. To the solution, 140 ml of 0.21 M silver nitrate aqueous solution (solution 1) and 140 ml of 0.21 M sodium chloride aqueous solution (solution 2) were added according to a double jet method for 10 minutes while stirring the gelatin solution at 50° C. After 10 minutes, 320 ml of 2.2 M silver nitrate aqueous solution (solution 3) and 320 ml of 2.2 M sodium chloride aqueous solution (solution 4) were added to the mixture according to a double jet method for 35 minutes. After 5 minutes, the mixture was cooled to 35° C. Soluble salts were removed according to a conventional flocculation method. The mixture was heated to 40° C. Gelatin was further dissolved in the mixture. Further, sodium chloride and phenol were added to the mixture. The obtained emulsion was adjusted to pH 6.5. Thus, a monodispersed cubic silver chloride emulsion was obtained. The average edge length of the cubic grains was 0.5 $\mu$m. The distribution coefficient was 15%.

Emulsions B-1 to B-3: cubic silver chloride emulsions doped With $(NH_4)_2[RhCl_5(H_2O)]$ The procedure of the above-mentioned preparation of Emulsion A was repeated except that $1\times10^{-8}$ M (B-1), $1\times10^{-7}$ M (B-2) or $1\times10^{-6}$ M (B-3) of $(NH_4)_2[RhCl_5(H_2O)]$ (based on 1 mol of silver halide) was added to the solution 4.

Emulsions C-1 to C-3: cubic silver chloride emulsions doped with $K_3[Cr(CN)_6]$ The procedure of the above-mentioned preparation of Emulsion A was repeated except that $1\times10^{-8}$ M (C-1), $1\times10^{-7}$ M (C-2) or $1\times10^{-6}$ M (C-3) of $K_3[Cr(CN)_6]$ (based on 1 mol of silver halide) was added to the solution 4.

Gelatin and sodium dodecylbenzenesulfonate were added to each of the Emulsions A, B-1 to B-3 and C-1 to C-3 to prepare coating solutions. Each of the coating solutions and a solution for a protective layer were simultaneously coated on a cellulose triacetate film support having an undercoating layer according to an extrusion method. The solution for the protective layer contains gelatin, polymethyl methacrylate particles and sodium salt of 2,4-dichloro-6-hydroxy-s-triazine. The coating amount (based on silver) of the emulsion was 2 g/m$^2$.

The samples were exposed to light for sensitometry (10 seconds) through an optical wedge. The samples were developed for 5 minutes at 20° C. using the following MAA-1* developing solution. The development was stopped, and the samples were fixed, washed with water and dried according to a conventional method. The optical density was measured with respect to each of the samples.

| MAA1* developing solution | | |
|---|---|---|
| Metol | 2.5 | g |
| L-ascorbic acid | 10.0 | g |
| Nabox | 35.0 | g |
| NaCl | 0.58 | g |
| Water (make up to) | 1 | liter |

The samples were evaluated as follows.

The fog is evaluated as the minimum optical density of the sample.

The sensitivity is expressed by a relative reciprocal value of the exposure required to obtain an optical density of the fogging value plus 0.5. The relative value is defined in the manner that the value of the sample A is 100.

The gradation means the gradient at the straight line portion of the characteristic curve. A hard gradation has a large gradient.

The toe density is expressed by subtracting the minimum optical density from an optical density that is obtained by exposing a sample to an exposure corresponding to 0.8×the exposure defined in the sensitivity. A sample showing a small toe density has a steep rise at the toe.

The results are set forth in Table 1.

TABLE 1

| Emulsion | Dopant Compound | Dopant Amount | Fog | Sensitivity | Gradation | Toe density |
|---|---|---|---|---|---|---|
| A | None | | 0.06 | 100 | 2.6 | 0.32 |
| B-1 | $(NH_4)_2[RhCl_5(H_2O)]$ | $1\times10^{-8}$ | 0.05 | 56 | 1.9 | 0.33 |
| B-2 | $(NH_4)_2[RhCl_5(H_2O)]$ | $1\times10^{-7}$ | 0.05 | 39 | 3.2 | 0.27 |
| B-3 | $(NH_4)_2[RhCl_5(H_2O)]$ | $1\times10^{-6}$ | 0.05 | 5 | 4.1 | 0.21 |
| C-1 | $K_3[Cr(CN)_6]$ | $1\times10^{-8}$ | 0.05 | 74 | 2.3 | 0.32 |
| C-2 | $K_3[Cr(CN)_6]$ | $1\times10^{-7}$ | 0.05 | 47 | 2.6 | 0.28 |
| C-3 | $K_3[Cr(CN)_6]$ | $1\times10^{-6}$ | 0.05 | 10 | 5.7 | 0.07 |

EXAMPLE 2

A silver bromide fine particle emulsion ($1\times10^{-2}$ mol based on 1 mol of silver), sodium thiosulfate ($2.5\times10^{-6}$ mol based on 1 mol of silver) and chloroauric acid ($3\times10^{-7}$ mol based on 1 mol of silver) were added to each of the Emulsions A, B-2, B-3, C-2 and C-3 prepared in Example 1. The emulsions were chemically sensitized at 60° C. under the optimum conditions.

The samples were prepared and evaluated in the same manner as in Example 1. The results are set forth in Table 2.

TABLE 2

| Emulsion | Dopant Compound | Dopant Amount | Fog | Sensitivity | Gradation | Toe density |
|---|---|---|---|---|---|---|
| A | None | | 0.10 | 100 | 2.2 | 0.36 |
| B-2 | $(NH_4)_2[RhCl_5(H_2O)]$ | $1\times10^{-7}$ | 0.08 | 40 | 2.6 | 0.32 |
| B-3 | $(NH_4)_2[RhCl_5(H_2O)]$ | $1\times10^{-6}$ | 0.09 | 5 | 3.7 | 0.23 |
| C-2 | $K_3[Cr(CN)_6]$ | $1\times10^{-7}$ | 0.07 | 64 | 4.0 | 0.25 |
| C-3 | $K_3[Cr(CN)_6]$ | $1\times10^{-6}$ | 0.05 | 9 | 6.4 | 0.15 |

EXAMPLE 3

The mercapto heterocyclic compound (III-2-2) or the tetrazaindene compound (IV-1) was added to each of the Emulsions A, B-3 and C-3 prepared in Example 1. The amount of the compound was $5\times10^{-3}$ mol based on 1 mol of silver.

The samples were prepared and evaluated in the same manner as in Example 1.

Additionally, the maximum optical density (Dmax) and Δlog E was determined. Δlog E is expressed by subtracting the sensitivity of the sample immediately after preparation from the sensitivity of the sample heated at 50° C. for 3 days.

The results are set forth in Table 3. In Table 3, the results of Example 1 (A, B-3 and C-3) are set forth again for reference.

TABLE 3

| Emulsion | Dopant | Additive | Fog | Sensitivity | Gradation | Toe density | Dmax | Δlog E |
|---|---|---|---|---|---|---|---|---|
| A | None | None | 0.06 | 100 | 2.6 | 0.32 | 1.85 | +0.96 |
| B-3 | Rh | None | 0.05 | 5 | 4.1 | 0.21 | 1.35 | +0.44 |
| C-3 | Cr | None | 0.05 | 10 | 5.7 | 0.07 | 1.40 | +0.25 |
| A | None | III | 0.05 | 115 | 2.8 | 0.27 | 1.98 | +0.47 |
| B-3 | Rh | III | 0.05 | 8 | 4.4 | 0.20 | 2.10 | +0.28 |
| C-3 | Cr | III | 0.05 | 11 | 5.9 | 0.06 | 2.12 | +0.12 |
| A | None | IV | 0.05 | 113 | 2.7 | 0.32 | 1.99 | +0.42 |
| B-3 | Rh | IV | 0.05 | 7 | 4.3 | 0.21 | 2.18 | +0.33 |
| C-3 | Cr | IV | 0.05 | 11 | 5.8 | 0.06 | 2.11 | +0.14 |

(Remark)
Rh: $(NH_4)_2[RhCl_5(H_2O)]$ (amount: $1\times10^{-6}$)
Cr: $K_3[Cr(CN)_6]$ (amount: $1\times10^{-6}$)
III: Compound III-2-2 (amount: $5\times10^{-3}$)
IV: Compound IV-1 (amount: $5\times10^{-3}$)

EXAMPLE 4

The mercapto heterocyclic compound (III-2-2) or the tetrazaindene compound (IV-1) was added to each of the Emulsions A, B-3 and C-3 prepared in Example 2 after the chemical sensitization. The amount of the compound was $5\times10^{-3}$ mol based on 1 mol of silver.

The samples were prepared and evaluated in the same manner as in Example 3.

The results are set forth in Table 4. In Table 4, the results of Example 2 (A, B-3 and C-3) are set forth again for reference.

TABLE 4

| Emulsion | Dopant | Additive | Fog | Sensitivity | Gradation | Toe density | Dmax | Δlog E |
|---|---|---|---|---|---|---|---|---|
| A | None | None | 0.10 | 100 | 2.2 | 0.36 | 1.85 | +0.34 |
| B-3 | Rh | None | 0.09 | 5 | 3.7 | 0.23 | 1.65 | +0.24 |
| C-3 | Cr | None | 0.05 | 9 | 6.4 | 0.15 | 1.60 | +0.15 |
| A | None | III | 0.08 | 108 | 2.5 | 0.42 | 1.88 | +0.23 |
| B-3 | Rh | III | 0.07 | 7 | 4.6 | 0.22 | 2.12 | +0.18 |
| C-3 | Cr | III | 0.07 | 10 | 6.7 | 0.13 | 2.14 | +0.09 |
| A | None | IV | 0.08 | 109 | 2.7 | 0.44 | 1.89 | +0.22 |
| B-3 | Rh | IV | 0.07 | 9 | 4.5 | 0.23 | 2.10 | +0.18 |
| C-3 | Cr | IV | 0.06 | 11 | 6.6 | 0.12 | 2.12 | +0.08 |

(Remark)
Rh: $(NH_4)_2[RhCl_5(H_2O)]$ (amount: $1 \times 10^{-6}$)
Cr: $K_3[Cr(CN)_6]$ (amount: $1 \times 10^{-6}$)
III: Compound III-2-2 (amount: $5 \times 10^{-3}$)
IV: Compound IV-1 (amount: $5 \times 10^{-3}$)

EXAMPLE 5

Preparation of Silver Chlorobromide (chloride: 99%) Emulsion

A silver bromide fine particle emulsion ($1\times10^{-2}$ mol based on 1 mol of silver), sodium thiosulfate and chloroauric acid were added to the Emulsion A prepared in Example 1. The emulsion was chemically sensitized at 60° C. under the optimum conditions. Further, the tetrazaindene compound (IV-1) was added to the emulsion in the amount of $5\times10^{-3}$ mol based on 1 mol of silver. The emulsion was coated on the support in the same manner as in Example 1.

The surface pH value was adjusted by adding sulfuric acid or sodium hydroxide to the coating solution. The surface pH value was measured according to the method described in the present specification.

Further, other samples were prepared in the same manner as is described above, except that $1\times10^{-6}$ M of $(NH_4)_2[RhCl_5(H_2O)]$ or $K_3[Cr(CN)_6]$ (based on 1 mol of silver halide) was added to the solution 4 in preparation of the Emulsion A.

Furthermore, other samples were prepared in the same manner as is described above, except that $1\times10^{-6}$ M of $K_2[IrCl_6]$ or $1\times10^{-5}$ M of $K_4[Fe(CN)_6]$ (based on 1 mol of silver halide) was added to the solution 4 in preparation of the Emulsion A.

The samples were evaluated in the same manner as in Example 3.

Preparation of Silver Chlorobromide (chloride: 50%) Emulsion

In 845 ml of an aqueous solution containing 2.3 g of sodium chloride and 4.6 g of potassium bromide, 25 g of deionized gelatin was dissolved. To the solution, 140 ml of 0.18 M silver nitrate aqueous solution (solution 5) and 140 ml of 0.10 M sodium chloride and 0.10 M potassium bromide aqueous solution (solution 6) were added according to a double jet method for 10 minutes while stirring the gelatin solution at 70° C. After 10 minutes, 320 ml of 2.2 M silver nitrate aqueous solution (solution 7) and 320 ml of 2.2 M sodium chloride aqueous solution (solution 8) were added to the mixture according to a double jet method for 70 minutes. After 5 minutes, the mixture was cooled to 35° C. Soluble salts were removed according to a conventional flocculation method. The mixture was heated to 40° C. Gelatin was further dissolved in the mixture. Further, sodium chloride, potassium bromide and phenol were added to the mixture. The obtained emulsion was adjusted to pH 6.5. Thus, a monodispersed cubic silver chlorobromide emulsion was obtained. The average edge length of the cubic grains was 0.5 μm. The distribution coefficient was 17%.

Sodium thiosulfate, chloroauric acid and potassium thiocyanate were added to the above-prepared emulsion. The emulsion was chemically sensitized at 60° C. under the optimum conditions. Further, the tetrazaindene compound (IV-1) was added to the emulsion in the amount of $5\times10^{-3}$ mol based on 1 mol of silver. The emulsion was coated on the support in the same manner as in Example 1.

The surface pH value was adjusted by adding sulfuric acid or sodium hydroxide to the coating solution. The surface pH value was measured according to the method described in the present specification.

Further, other samples were prepared in the same manner as is described above, except that $1\times10^{-6}$ M of $(NH_4)_2[RhCl_5(H_2O)]$ or $K_3[Cr(CN)_6]$ (based on 1 mol of silver halide) was added to the solution 8 in preparation of the emulsion.

Furthermore, other samples were prepared in the same manner as is described above, except that $1\times10^{-6}$ M of $K_2[IrCl_6]$ or $1\times10^{-5}$ M of $K_4[Fe(CN)_6]$ (based on 1 mol of silver halide) was added to the solution 8 in preparation of the emulsion.

The samples were evaluated in the same manner as in Example 3, except that the following MAA-1 developing solution was used in place of the MAA-1* developing solution.

| MAA-1 developing solution | | |
|---|---|---|
| Metol | 2.5 | g |
| L-ascorbic acid | 10.0 | g |
| Nabox | 35.0 | g |
| KBr | 1.0 | g |
| Water (make up to) | 1 | liter |

Preparation of Silver Bromide (chloride: 0%) Emulsion

In 870 ml of water, 36 g of deionized gelatin and 0.25 g of potassium bromide were dissolved. To the solution, 36 ml of 0.088 M silver nitrate aqueous solution (solution 9) and 36 ml of 0.088 M potassium bromide aqueous solution (solution 10) were added according to a double jet method for 10 minutes while stirring the gelatin solution at 75° C. Further, 179 ml of the solution 9 and 176 ml of the solution 10 were added to the mixture according to a double jet method for 7 minutes. Furthermore, 989 ml of 0.82 M silver nitrate aqueous solution (solution 11) was added to the mixture for 95 minutes while accelerating the feeding rate from the initial rate of 0.53 ml per minute. Simultaneously, 0.90 M potassium bromide aqueous solution (solution 12) was added to the mixture while controlling the silver potential at +120 mV (based on calomel electrode). After 5 minutes, the mixture was cooled to 35° C. Soluble salts were removed according to a conventional flocculation method. After the mixture was heated to 40° C., 50 g of gelatin was further dissolved in the mixture. Further, potassium bromide and phenol were added to the mixture. The obtained emulsion was adjusted to pH 6.5. Thus, a monodispersed cubic silver bromide emulsion was obtained. The average edge length of the cubic grains was 0.5 μm. The distribution coefficient was 13%.

Sodium thiosulfate, chloroauric acid and potassium thiocyanate were added to the above-prepared emulsion. The emulsion was chemically sensitized at 60° C. under the optimum conditions. Further, the tetrazaindene compound (IV-1) was added to the emulsion in the amount of $5\times10^{-3}$ mol based on 1 mol of silver. The emulsion was coated on the support in the same manner as in Example 1.

The surface pH value was adjusted by adding sulfuric acid or sodium hydroxide to the coating solution. The surface pH value was measured according to the method described in the present specification.

Further, other samples were prepared in the same manner as is described above, except that $1\times10^{-5}$ M or $1\times10^{-6}$ M of $(NH_4)_2[RhCl_5(H_2O)]$ or $K_3[Cr(CN)_6]$ (based on 1 mol of silver halide) was added to the solution 8 in preparation of the emulsion.

Furthermore, other samples were prepared in the same manner as is described above, except that $1\times10^{-6}$ M of $K_2[IrCl_6]$ or $1\times10^{-5}$ M of $K_4[Fe(CN)_6]$ (based on 1 mol of silver halide) was added to the solution 12 in preparation of the emulsion.

The samples were evaluated in the same manner as in Example 3, except that the MAA-1 developing solution was used in place of the MAA-1* developing solution.

The results are set forth in Table 5.

TABLE 5

| Cl % | Dopant (I) | Dopant (II) | Surface pH | Fog | Sensitivity | Gradation | Toe density | Dmax | Δlog E (+) |
|---|---|---|---|---|---|---|---|---|---|
| 99 | Rh | None | 5.7 | 0.07 | 100 | 4.5 | 0.23 | 2.10 | 0.18 |
| 99 | Rh | Ir | 5.8 | 0.07 | 103 | 4.7 | 0.21 | 2.12 | 0.15 |
| 99 | Rh | Fe | 5.9 | 0.06 | 101 | 4.8 | 0.22 | 2.11 | 0.17 |
| 99 | Cr | None | 5.8 | 0.06 | 125 | 6.6 | 0.12 | 2.12 | 0.08 |
| 99 | Cr | Ir | 5.7 | 0.07 | 128 | 6.8 | 0.10 | 2.13 | 0.06 |
| 99 | Cr | Fe | 5.9 | 0.06 | 124 | 6.7 | 0.11 | 2.13 | 0.07 |
| 50 | Rh | None | 5.6 | 0.06 | 100 | 4.0 | 0.26 | 1.99 | 0.15 |
| 50 | Rh | Ir | 5.8 | 0.08 | 105 | 4.2 | 0.25 | 2.02 | 0.12 |
| 50 | Rh | Fe | 5.7 | 0.07 | 102 | 4.3 | 0.25 | 2.05 | 0.13 |
| 50 | Cr | None | 5.7 | 0.07 | 119 | 4.3 | 0.19 | 2.00 | 0.12 |
| 50 | Cr | Ir | 5.8 | 0.07 | 122 | 4.5 | 0.17 | 2.07 | 0.10 |
| 50 | Cr | Fe | 5.9 | 0.08 | 120 | 4.6 | 0.18 | 2.06 | 0.12 |
| 0 | Rh* | None | 5.8 | 0.07 | 100 | 3.0 | 0.28 | 2.01 | 0.30 |
| 0 | Rh | None | 5.7 | 0.08 | 13 | 3.9 | 0.25 | 1.95 | 0.30 |
| 0 | Cr* | None | 5.9 | 0.08 | 180 | 2.6 | 0.29 | 2.00 | 0.31 |
| 0 | Cr | None | 5.8 | 0.07 | 60 | 3.0 | 0.28 | 1.97 | 0.30 |

(Remark)
Rh: $(NH_4)_2[RhCl_5(H_2O)]$ (amount: $1\times10^{-6}$)
Rh*: $(NH_4)_2[RhCl_5(H_2O)]$ (amount: $1\times10^{-7}$)
Cr: $K_3[Cr(CN)_6]$ (amount: $1\times10^{-6}$)
Cr*: $K_3[Cr(CN)_6]$ (amount: $1\times10^{-7}$)
Ir: $K_2[IrCl_6]$ (amount: $1\times10^{-6}$)
Fe: $K_4[Fe(CN)_6]$ (amount: $1\times10^{-5}$)

EXAMPLE 6

Preparation of Emulsion D

To a gelatin solution containing the tetrazaindene compound IV-1 (amount: $5\times10^{-3}$ mol based on 1 mol of silver), a silver nitrate aqueous solution and a sodium chloride aqueous solution containing $(NH_4)_2[RhCl_5(H_2O)]$ (amount: $4\times10^{-5}$ mol based on 1 mol of silver) were simultaneously added for 7 minutes while keeping the silver potential at 95 mV to prepare core grains of 0.12 μm. Further, a silver nitrate aqueous solution and sodium chloride aqueous solution containing $(NH_4)_2[RhCl_5(H_2O)]$ (amount: $1.2\times10^{-4}$ mol based on 1 mol of silver) were simultaneously added for 14 minutes while keeping the silver potential at 95 mV to prepare a cubic silver chloride emulsion. The average grain size was 0.15 μm.

Preparation of Emulsion E

An Emulsion E was prepared in the same manner as in the preparation of the emulsion D, except that the amount of $(NH_4)_2[RhCl_5(H_2O)]$ (used in each of the core and the shell) was $6.52\times10^{-5}$ mol based on 1 mol of silver Preparation of Emulsion F An Emulsion E was prepared in the same manner as in the preparation of the emulsion D, except that $K_3[Cr(CN)_6]$ was used in place of $(NH_4)_2[RhCl_5(H_2O)]$.

Preparation of Emulsion G

An Emulsion G was prepared in the same manner as in the preparation of the emulsion E, except that $K_3[Cr(CN)_6]$ was used in place of $(NH_4)_2[RhCl_5(H_2O)]$.

Preparation of Emulsion H

An Emulsion H was prepared in the same manner as in the preparation of the emulsion D, except that $8\times10^{-5}$ mol (based on 1 mol of silver) of $K_3[Cr(CN)_6]$ was used for the formation of the core in place of $(NH_4)_2[RhCl_5(H_2O)]$, and $2.4\times10^{-4}$ mol (based on 1 mol of silver) of $K_3[Cr(CN)_6]$ was used for the formation of the shell in place of $(NH_4)_2[RhCl_5(H_2O)]$.

Preparation of Emulsion I

An Emulsion I was prepared in the same manner as in the preparation of the emulsion D, except that $4\times10^{-4}$ mol (based on 1 mol of silver) of $K_3[Cr(CN)_6]$ was used for the formation of the core and the shell in place of $(NH_4)_2[RhCl_5(H_2O)]$.

Formation of Coated Sample (First photographic emulsion layer)

The following additives were added to the Emulsion D to prepare a coating solution. The solution was coated on a support (described below). The silver coating amount was 1.7 g/m², and the gelatin coating amount was 0.9 g/m².

| First photographic emulsion layer | | |
|---|---|---|
| Latex of polyethyl acrylate (average particle size: 0.05 μm) | 0.6 | g/m² |
| 4-Hydroxy-6-methyl-1,3,3a,7-tetrazaindene | 30 | mg/m² |
| Compound A | 40 | mg/m² |
| Compound B | 10 | mg/m² |
| Hardening agent (compound C) | 98 | mg/m² |
| Compound D | 53 | mg/m² |

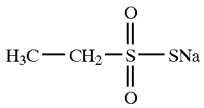

Compound A

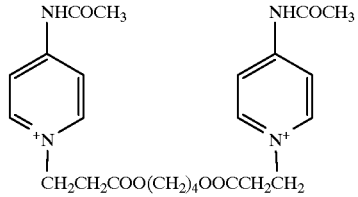

Compound B

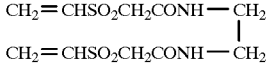

Compound C

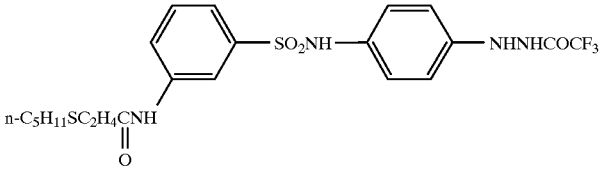

Compound D (Second photographic emulsion layer)

A second photographic emulsion layer was formed on the first photographic emulsion layer in the same manner as in the formation of the first layer, except that the emulsion E was used and the compound D was not used. The silver coating amount of the second layer was 1.3 g/m$^2$, and the gelatin coating amount was 0.7 g/m$^2$.

(Lower protective layer)

The following lower protective layer was coated on the second photographic emulsion layer.

| Lower protective layer | | |
|---|---|---|
| 1-Hydroxy-2-benzaldoxime | 15 | mg/m$^2$ |
| Compound E | 80 | mg/m$^2$ |
| Compound F | 10 | mg/m$^2$ |
| Polyethyl acrylate latex (average particle size: 0.05 $\mu$m) | 0.28 | g/m$^2$ |
| Gelatin | 0.7 | g/m$^2$ |

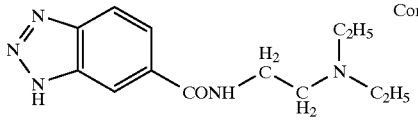

Compound E

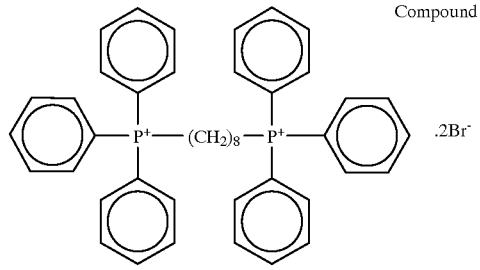

Compound F (Upper protective layer)

The following upper protective layer was coated on the lower protective layer.

| Upper protective layer | | |
|---|---|---|
| Amorphous matting agent (silicone dioxide, average particle size: 3.0 $\mu$m) | 30 | mg/m$^2$ |
| Spherical matting agent (polymethyl methacrylate, average particle size: 2.7 $\mu$m) | 30 | mg/m$^2$ |
| Gelatin dispersion of liquid paraffin | 50 | mg/m$^2$ |
| Potassium N-perfluorooctanesulfonyl-N-propylglycine | 5 | mg/m$^2$ |
| Sodium dodecylbenzenesulfonate | 10 | mg/m$^2$ |
| Water-soluble dye (Compound G) | 45 | mg/m$^2$ |
| Gelatin | 0.95 | g/m$^2$ |

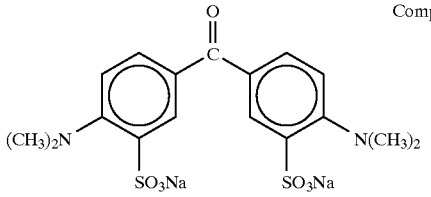

Compound G (Support)

The following first and second undercoating layers were coated on the both surface of a biaxially stretched polyethylene terephthalate film (thickness: 100 $\mu$m).

(First undercoating layer)

To the following components, 10 wt. % aqueous solution of potassium hydroxide was added. The mixture was adjusted to pH 6 to prepare a coating solution. The coating solution was coated and dried at 180° C. for 2 minutes to form the first undercoating layer (dry thickness: 0.9 $\mu$m).

| First undercoating layer | | |
|---|---|---|
| The following vinylidene chloride copolymer (core-shell type) | 15 | g |
| 2,4-Dichloro-6-hydroxy-s-triazine | 0.25 | g |
| Polystyrene particles (average particle size: 3 $\mu$m) | 0.05 | g |

-continued

| First undercoating layer | | |
|---|---|---|
| Compound H | 0.20 | g |
| Colloidal silica (particle size: 70 to 100 μm, Sunotechs, Nissan Chemical Co., Ltd.) | 0.12 | g |
| Water (make up to) | 100 | g |

Vinylidene chloride copolymer

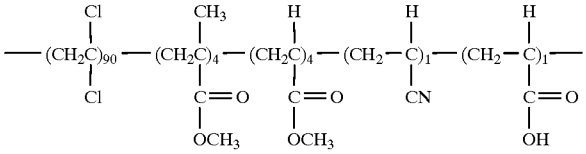

VDC MMA MA AN AA

Core: VDC/MMA/MA (80 wt. %)
Shell: VDC/AN/AA (20 wt. %)
Average particle size: 70 nm Compound H

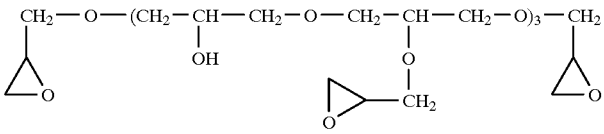

(Second undercoating layer)

The following coating solution was coated and dried at 170° C. for 2 minutes to form the second undercoating layer (dry thickness: 0.1 μm).

| Second undercoating layer | | |
|---|---|---|
| Gelatin | 1 | g |
| Methyl cellulose | 0.25 | g |
| Compound I | 0.02 | g |
| $C_{12}H_{25}O(CH_2CH_2O)_{10}H$ | 0.03 | g |
| Compound J | $3.5 \times 10^{-3}$ | g |
| Acetic acid | 0.2 | g |
| Water (make up to) | 100 | g |

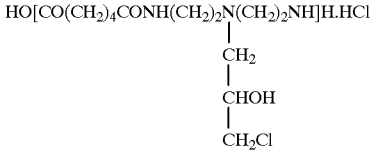

Compound I

-continued

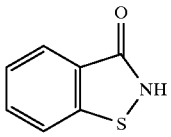

Compound J

Further, the following conductive layer and the backing layer were simultaneously coated on the back side of the support.

| Conductive layer | |
|---|---|
| $SnO_2$/Sb (=9/1 weight ratio, average particle size: 0.25 μm) | 200 mg/m$^2$ |
| Gelatin ($Ca^{2+}$ content: 3,000 ppm) | 77 mg/m$^2$ |
| Compound K | 7 mg/m$^2$ |
| Sodium dodecylbenzenesulfonate | 10 mg/m$^2$ |
| Sodium dihexyl-α-sulfosuccinate | 40 mg/m$^2$ |
| Sodium polystyrenesulfonate | 9 mg/m$^2$ |

Compound K

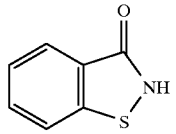

| Backing layer | | |
|---|---|---|
| Gelatin ($Ca^{2+}$ content: 30 ppm) | 2.82 | g/m$^2$ |
| Polymethyl methacrylate particles (average particle size: 3.4 $\mu$m) | 54 | mg/m$^2$ |
| Compound K | 3 | mg/m$^2$ |
| Compound L | 40 | mg/m$^2$ |
| Compound M | 40 | mg/m$^2$ |
| Compound N | 80 | mg/m$^2$ |
| Compound O | 120 | mg/m$^2$ |
| Sodium dodecylbenzenesulfonate | 75 | mg/m$^2$ |
| Sodium dihexyl-$\alpha$-sulfosuccinate | 20 | mg/m$^2$ |
| Compound P | 5 | mg/m$^2$ |
| Sodium sulfate | 50 | mg/m$^2$ |
| Sodium acetate | 85 | mg/m$^2$ |
| 1,2-Bis(vinylsulfonylacetamido) ethane | 150 | mg/m$^2$ |

(Compound L)

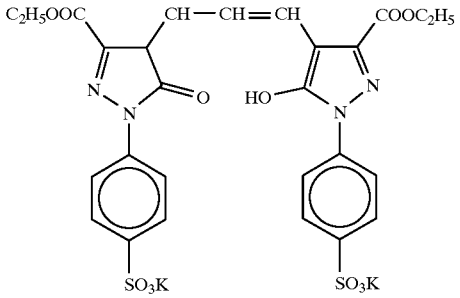

Compound M

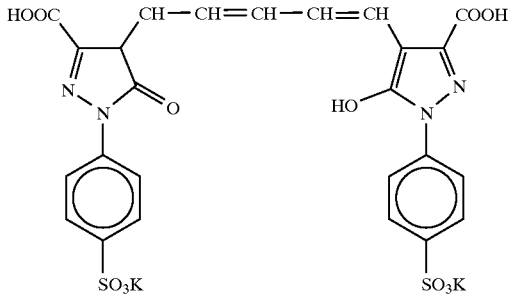

-continued

Compound N

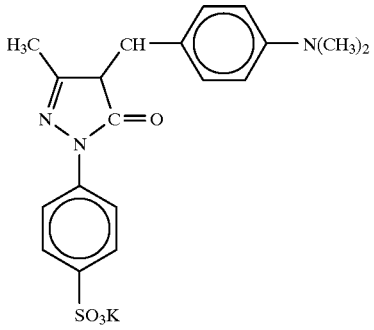

Compound O

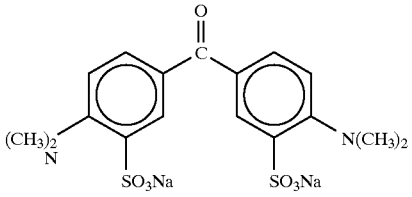

Compound P

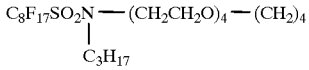

Thus, a sample No. 41 was prepared.

A sample No. 42 was prepared in the same manner as in the preparation of No. 41, except that the emulsion F was used for the first photographic layer in place of the emulsion D, and the emulsion G was used for the second layer in place of the emulsion E.

A sample No. 43 was prepared in the same manner as in the preparation of No. 41, except that the emulsion H was used for the first layer in place of the emulsion D, and the emulsion I was used for the second layer in place of the emulsion E.

The samples were evaluated as follows.

The samples were exposed through an optical wedge in a light room printer (P-627 FM, Dainippon Screen Co., Ltd.). They were developed in an automatic developing machine (FG-680A, Fuji Photo Film Co., Ltd.) at 38° C. for 20 seconds. The developing solution is shown below.

| Developing solution | | |
|---|---|---|
| Potassium hydroxide | 35.0 | g |
| Diethylenetriaminetetracetic acid | 2.0 | g |
| Potassium carbonate | 12.0 | g |
| Sodium metabisulfite | 40.0 | g |
| Potassium bromide | 3.0 | g |
| Hydroquinone | 25.0 | g |
| 5-Methylbenzotriazole | 0.08 | g |
| 4-Hydroxymethyl-4-methyl-1-phenyl-3-pyrazolidone | 0.45 | g |
| 2,3,5,6,7,8-Hexahydro-2-thoxo-4-(1H)-quinazolidone | 0.04 | g |
| Sodium 2-mercaptobenzimidazole-5-sulfonate | 0.15 | g |
| Sodium erysorbate | 3.0 | g |
| Water (make up to) | 1 | liter |
| Potassium hydroxide (make up to) | pH 10.5 | |

The samples were fixed according to a conventional process.

The practical sensitivity was evaluated using an original of dots and thin lines. The original had 50% dotted area. In more detail, the sensitivity is expressed by a relative reciprocal value of the optimum exposure required to obtain an image having 50% dotted area. The relative value is defined in the manner that the value of the sample 41 is 100.

The practical maximum density was measured at the above-mentioned optimum exposure.

The gradation is a relative value, which is defined in the manner that the value of the sample 41 is 100.

Further, the quality of outlined characters were examined. The quality was evaluated as five grades. At the grade 5, a character of 30 μm width is clearly represented at the above-mentioned optimum exposure. At the grade 1, only the character of 150 μm width or more is represented at the optimum exposure. The intermediate grades 2 to 4 were set according to a sensory evaluation. The grades 3 to 5 are of practical level.

The results are set forth in Table 6.

TABLE 6

| Sample | Dopant | Sensitivity | Dmax | Gradation | Character |
|---|---|---|---|---|---|
| 41 | $(NH_4)_2[RhCl_5(H_2O)]$ | 100 | 5.2 | 100 | 3 |
| 42 | $K_3[Cr(CN)_6]$ | 115 | 5.4 | 91 | 4 |
| 43 | $K_3[Cr(CN)_6]$* | 99 | 5.3 | 105 | 5 |

(Remark)
$K_3[Cr(CN)_6]$*: Relatively large amount

EXAMPLE 7

(Emulsion J)

In 800 ml of distilled water, 32 g of lime-treated gelatin was dissolved at 40° C. To the solution, 5.76 g of sodium chloride was added. The mixture was heated to 55° C. To the solution, 1 ml of 1% aqueous solution of N,N'-dimehtylimidazoline-2-thione was added. To the mixture, a solution of 100 g of silver nitrate in 400 ml of distilled water and a solution of 34.4 g of sodium chloride in 400 ml of distilled water were added at 55° C. for 35 minutes. To the mixture, a solution of 59.2 g of silver nitrate in 200 ml of distilled water and a solution of 17.1 g of sodium chloride in 200 ml of distilled water were further added at 55° C. for 18 minutes. The mixture was cooled to 40° C. The following red sensitizing dye ($4\times10^{-5}$ mol based on 1 mol of silver halide) was added to the mixture. To the mixture, a solution of 0.8 g of silver nitrate in 100 ml of distilled water and a solution of 0.56 g of potassium bromide in 100 ml of distilled water were further added at 40° C. for 10 minutes. The emulsion was desalted and washed with water. To the emulsion, 90 g of lime-treated gelatin was added. The emulsion was adjusted to pAg 7.3 and pH 6.2 using sodium chloride and sodium hydroxide. After the emulsion was heated to 50° C., the emulsion was subjected to a gold-sulfur sensitization under the optimum conditions. Thus silver chlorobromide emulsion (bromide: 0.5 mol %) was prepared.

(Emulsion K)

An Emulsion K was prepared in the same manner as in the preparation of the Emulsion J, except that $K_3[RhCl_6]$ was added to the sodium chloride solution for the second addition. The amount of $K_3[RhCl_6]$ was $1\times10^{-8}$ mol based on the total amount of silver chlorobromide.

(Emulsions L to S)

Emulsions L to S were prepared in the same manner as in the preparation of the Emulsion K, except that the metal complex compound and its amount were changed according to Table 7.

The emulsions J to S were observed with an electron microscope. Each of the emulsions J to S has an average grain size of 0.45 μm. The shape of the grain was cubic. The distribution coefficient was 0.09.

(Formation of photographic material 101)

The both sides of a paper were laminated with polyethylene to prepare a paper support. The surface of the support was subjected to a corona discharge treatment. A gelatin undercoating layer containing sodium dodecylbenzenesulfonate was coated on the surface. Further, the following photographic layers were provided on the support to obtain a multi-layered color paper (101).

(Preparation of the coating solution for the third layer)

In 32.5 g of the solvent (Solv-3), 97.5 g of the solvent (Solv-4), 65.0 g of the solvent (Solv-6) and 110 ml of ethyl acetate were dissolved 40.0 g of the magenta coupler (E×M), 40.0 g of the ultraviolet absorbent (UV-2), 7.5 g of the Color image stabilizer (Cpd-2), 25.0 g of the Color image stabilizer (Cpd-5), 2.5 g of the Color image stabilizer (Cpd-6), 20.0 g of the Color image stabilizer (Cpd-7), 2.5 g of the Color image stabilizer (Cpd-8) and 5.0 g of the Color image stabilizer (Cpd-10). The solution was emulsified in 150 g of 7 5 aqueous gelatin solution containing 70 g of 10% sodium dodecylbenzenesulfonate solution to obtain an emulsion A.

Independently, a silver chlorobromide emulsion was prepared. The grain shape was cubic. The emulsion comprises large grains (average grain size: 0.55 μm) and small grains (average grain size: 0.39 μm). The distribution coefficient of the large grains is 0.08, and that of the small grains is 0.06. The grains substantially consist of silver chloride having a surface in which 0.8 mol % of silver bromide is localized. The grains (including the localized phase) contain 0.1 mg of potassium hexachloroiridium(IV) and 1.0 g of potassium ferocyanate. The green sensitizing dyes D ($3.1\times10^{-4}$ mol), E ($4.0\times10^{-5}$ mol) and F ($2.0\times10^{-4}$ mol) were added to the large grains. The green sensitizing dyes D ($3.6\times10^{-4}$ mol), E ($7.0\times10^{-5}$ mol) and F ($2.8\times10^{-4}$ mol) were also added to the small grains. The emulsion was subjected to a chemical sensitization using a sulfur sensitizer, a gold sensitizer and decomposed nucleic acids under optimum conditions. The silver chlorobromide emulsion were mixed with the above-prepared emulsion A to prepare a coating solution for the third layer.

The coating solutions for the other (first to seventh) layers were prepared in a similar manner. Further, sodium 1-oxy-3,5-dichloro-s-triazine was used as a hardening agent for gelatin.

Furthermore, Cpd-12 and Cpd-13 were added to each of the layers. The total amount of Cpd-12 was 25.0 mg/m$^2$, and that of Cpd-13 was 50.0 mg/m$^2$.

The sensitizing dyes for the silver chlorobromide emulsions are shown below.

(Blue sensitive emulsion layer)
Sensitizing dye A

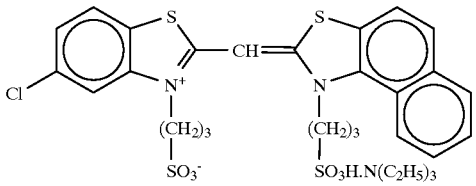

Sensitizing dye B

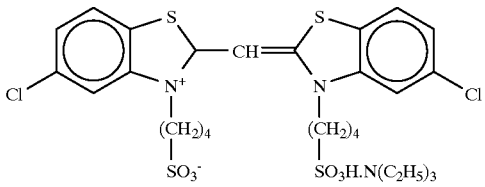

Sensitizing dye C

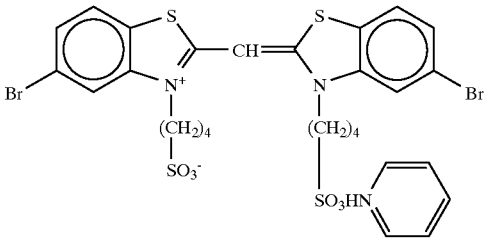

Each of the dyes was used in the amount of $1.4\times10^{-4}$ mol for the large grains or the amount of $1.7\times10^{-4}$ mol for the small grains.

(Green sensitive emulsion layer)
Sensitizing dye D

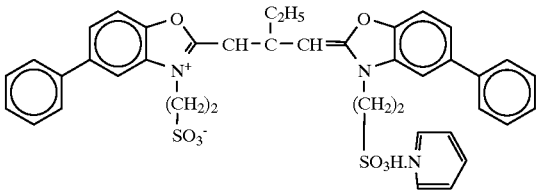

The dye D was used in the amount of $3.0\times10^{-4}$ mol for the large grains or the amount of $3.6\times10^{-4}$ mol for the small grains.

Sensitizing dye E

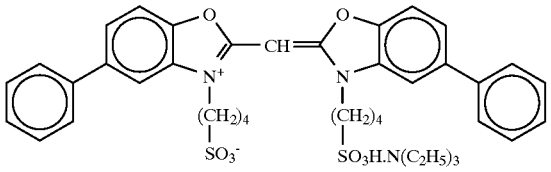

The dye E was used in the amount of $4.0\times10^{-5}$ mol for the large grains or the amount of $7.0\times10^{-5}$ mol for the small grains.

Sensitizing dye F

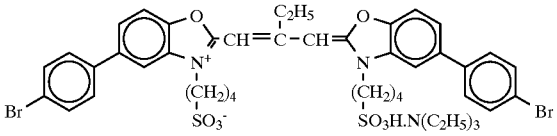

The dye F was used in the amount of $2.0\times10^{-4}$ mol for the large grains or the amount of $2.8\times10^{-4}$ mol for the small grains.

(Red sensitive emulsion layer)
Sensitizing dye G

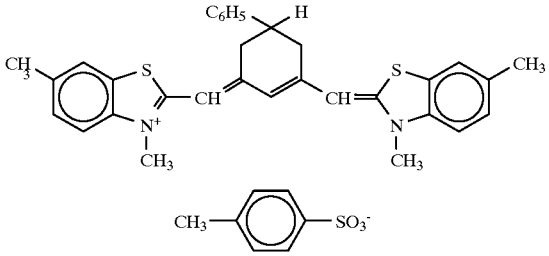

The dye G was used in the amount of $4.0\times10^{-5}$ mol.

Further, the following compound was added to the red sensitive silver halide emulsion in the amount of $2.6\times10^{-3}$ mol based on 1 mol of silver halide.

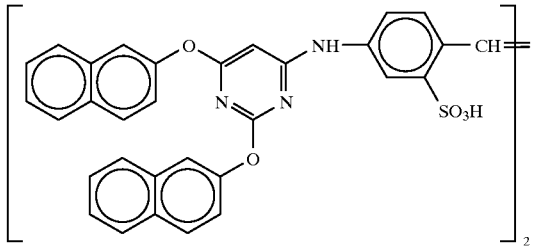

To the blue, green and red sensitive emulsion layers, 1-(5-methylureidophenyl)-5-mercaptotetrazole was added in the amount of $8.5\times10^{-4}$ (for blue), $3.0\times10^{-3}$ (for green) or $2.5\times10^{-4}$ (for red) mol based on 1 mol of silver halide.

To the blue and green sensitive emulsion layers, $K_3[Cr(CN)_6]$ was added in the amount of $1\times10^{-4}$ (for blue) or $2\times10^{-4}$ (for green) mol based on 1 mol of silver halide.

The following dyes were added to the emulsion layers as antiirradiation dyes.

Yellow dye

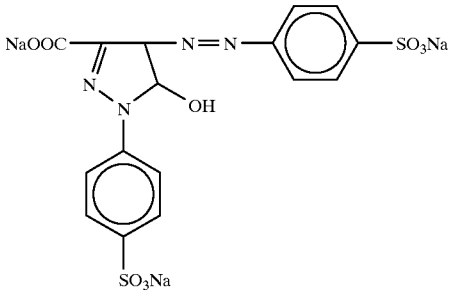

(Amount: 2.6 mg/m$^2$)

Magenta dye

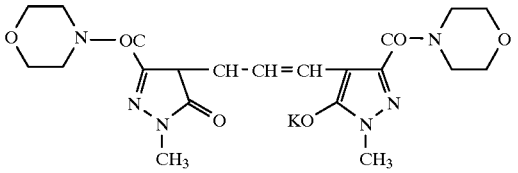

(Amount: 60 mg/m$^2$)

Cyan dye

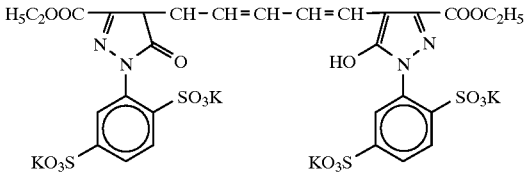

(Amount: 42 mg/m$^2$)

The surface pH was adjusted to 5.9.

(Layered structure)

Components of the layers are shown below. The value means the coating amount (g/m$^2$), except that the value of the silver halide emulsion means the amount of silver.

Support (A)

The resin layer on which the first layer was coated contained ultramarine as a blue dye.

| The first layer (blue sensitive emulsion layer) | |
|---|---|
| Silver chlorobromide emulsion (cubic grain shape average grain size of large grains: 0.88 μm, average grain size of small grains: 0.70 μm, the ratio of large grains to small grains is 5:5 (silver ratio), distribution coefficient of the large grains: 0.08, distribution coefficient of the small grains: 0.10, 0.3 mol % silver bromide localized phase, the content of potassium hexachloroiridium(IV): 0.1 mg based on 1 mol of silver, the content potassium ferrocyanide: 1.0 mg based on 1 mol of silver) | 0.27 |
| Gelatin | 1.22 |
| Yellow coupler (ExY) | 0.79 |
| Color image stabilizer (Cpd-1) | 0.08 |

-continued

| | |
|---|---|
| Color image stabilizer (Cpd-2) | 0.04 |
| Color image stabilizer (Cpd-3) | 0.08 |
| Color image stabilizer (Cpd-5) | 0.01 |
| Solvent (Solv-1) | 0.13 |
| Solvent (Solv-5) | 0.13 |
| The second layer (Color mixture preventing layer) | |
| Gelatin | 0.90 |
| Color mixture preventive (Cpd-4) | 0.08 |
| Solvent (Solv-1) | 0.10 |
| Solvent (Solv-2) | 0.15 |
| Solvent (Solv-3) | 0.25 |
| Solvent (Solv-8) | 0.03 |
| The third layer (Green sensitive emulsion layer) | |
| Silver chlorobromide emulsion (cubic grain shape, average grain size of large grains: 0.55 μm, average grain size of small grains: 0.39 μm, the ratio of large grains to small grains is 1:3 (silver ratio), distribution coefficient of the large grains: 0.08, distribution coefficient of the small grains: 0.6, 0.8 mol % silver bromide localized phase, the content of potassium hexachloroiridium(IV): 0.1 mg based on 1 mol of silver, the content of potassium ferrocyanide: 1.0 mg based on 1 mol of silver) | 0.13 |
| Gelatin | 1.45 |
| Magenta coupler (ExM) | 0.16 |
| Ultraviolet absorbent (UV-2) | 0.16 |
| Color image stabilizer (Cpd-2) | 0.03 |
| Color image stabilizer (Cpd-5) | 0.10 |
| Color image stabilizer (Cpd-6) | 0.01 |
| Color image stabilizer (Cpd-7) | 0.08 |
| Color image stabilizer (Cpd-8) | 0.01 |
| Color image stabilizer (Cpd-10) | 0.02 |
| Solvent (Solv-3) | 0.13 |
| Solvent (Solv-4) | 0.39 |
| Solvent (Solv-6) | 0.26 |
| The fourth layer (Color mixture preventing layer) | |
| Gelatin | 0.68 |
| Color mixture preventive (Cpd-4) | 0.06 |
| Solvent (Solv-1) | 0.06 |
| Solvent (Solv-2) | 0.07 |
| Solvent (Solv-3) | 0.18 |
| Solvent (Solv-8) | 0.02 |
| The fifth layer (Red sensitive emulsion layer) | |
| Silver chlorobromide emulsion A | 0.18 |
| Gelatin | 0.80 |
| Cyan coupler (ExC) | 0.33 |
| Ultraviolet absorbent (UV-2) | 0.18 |
| Color image stabilizer (Cpd-1) | 0.33 |
| Color image stabilizer (Cpd-2) | 0.03 |
| Color image stabilizer (Cpd-6) | 0.01 |
| Color image stabilizer (Cpd-8) | 0.01 |
| Color image stabilizer (Cpd-9) | 0.02 |
| Color image stabilizer (Cpd-10) | 0.01 |
| Solvent (Solv-1) | 0.01 |
| Solvent (Solv-7) | 0.22 |
| The sixth layer (Ultraviolet absorbing layer) | |
| Gelatin | 0.48 |
| Ultraviolet absorbent (UV-1) | 0.38 |
| Color image stabilizer (Cpd-5) | 0.01 |
| Color image stabilizer (Cpd-7) | 0.05 |
| Solvent (Solv-9) | 0.05 |
| The seventh layer (Protective layer) | |
| Gelatin | 0.90 |
| Polyvinyl alcohol modified with acrylate (modification degree: 17%) | 0.05 |
| Liquid paraffin | 0.02 |
| Color image stabilizer (Cpd-11) | 0.01 |

The compounds are shown below.
Yellow coupler (ExY)
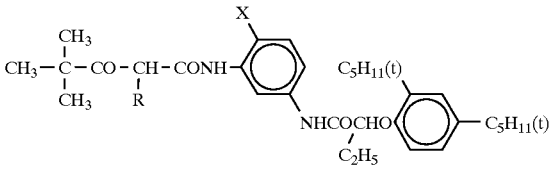
wherein R is
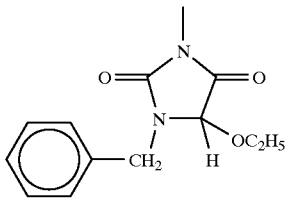
and X is Cl; or R is
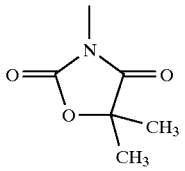
and X is $OCH_3$ (molar ratio=1:1).
Magenta coupler (ExM)
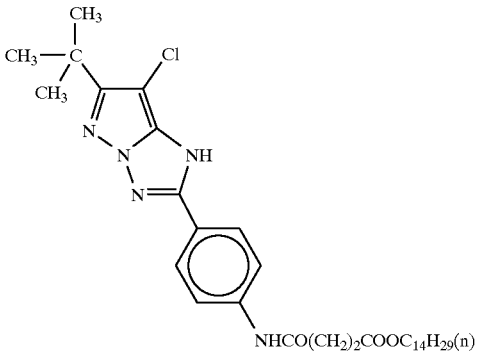
Cyan coupler (ExC)
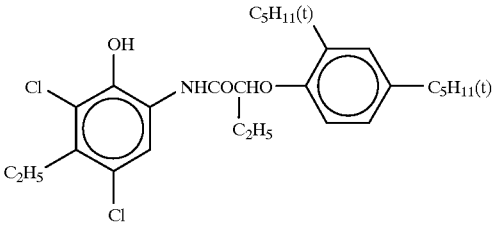
and
-continued
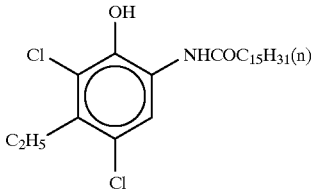
(molar ratio = 25:75)
Color image stabilizer (Cpd-1)
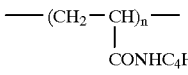
(average molecular weight: 60,000)
Color image stabilizer (Cpd-2)
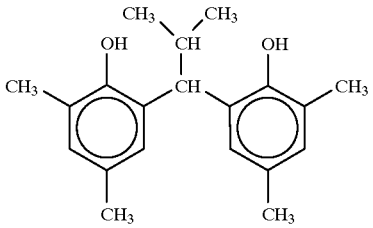
Color image stabilizer (Cpd-3)
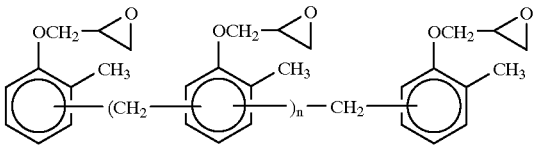
wherein n is 7 to 8 (average).
Color image stabilizer (Cpd-4)
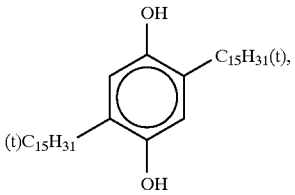
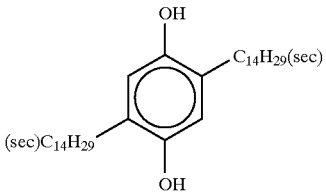
and -continued
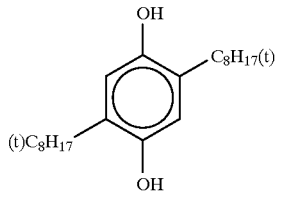
(weight ratio = 1:1:1)
Color image stabilizer (Cpd-5)
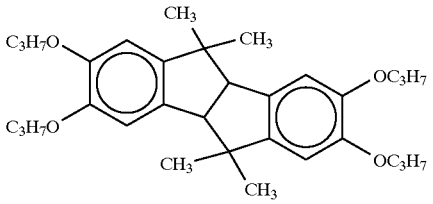
Color image stabilizer (Cpd-6)
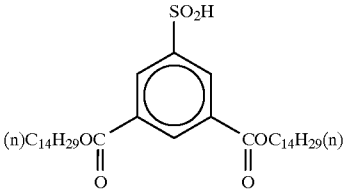
Color image stabilizer (Cpd-7)
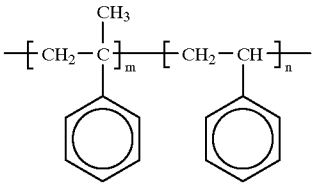
m:n = 9:1, average molecular weight is 600
Color image stabilizer (Cpd-8)
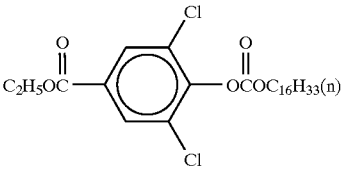
Color image stabilizer (Cpd-9)
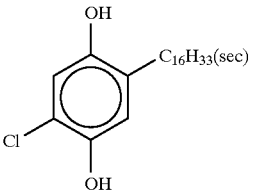
-continued
Color image stabilizer (Cpd-10)
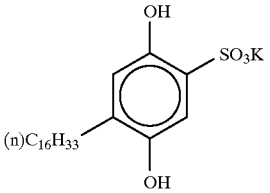
Cpd-11
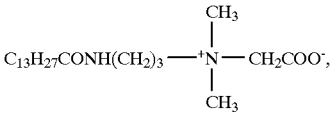
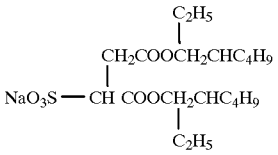
and
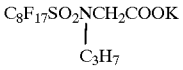
(weight ratio is 1:2:1)
Cpd-12
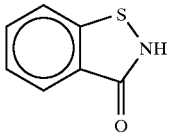
Cpd-13
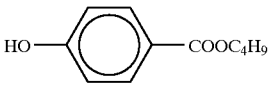
UV-1
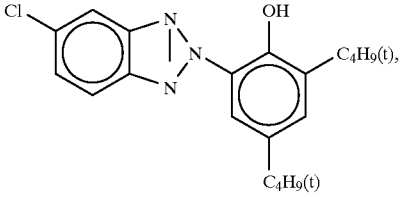

-continued
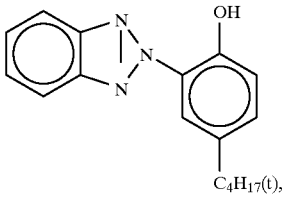
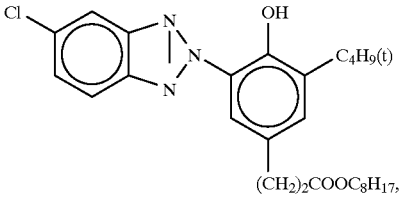
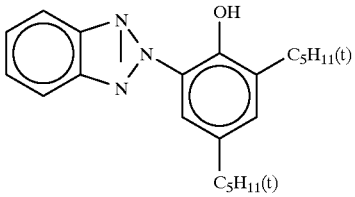
and
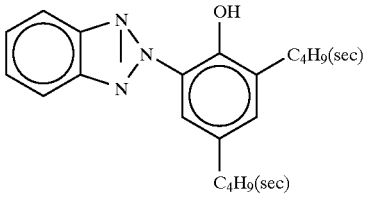
(weight ratio is 1:2:2:3:1)
UV-2
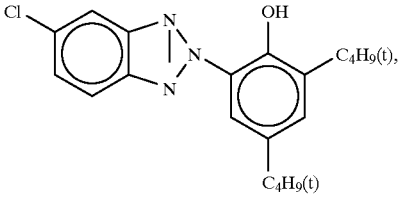
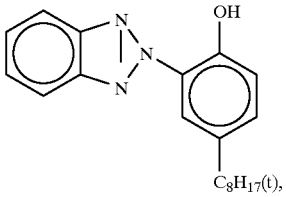
-continued
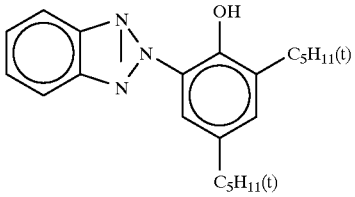
and
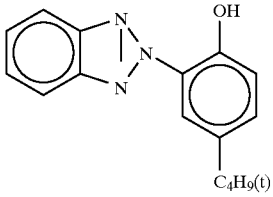
(weight ratio is 2:3:4:1)
Solv-1
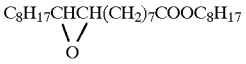
Solv-2
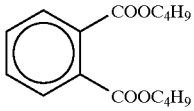
Solv-3
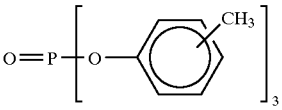
Solv-4
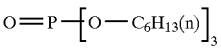
Solv-5
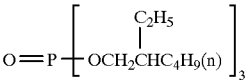
Solv-6
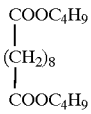

-continued

Solv-7

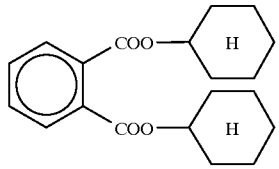

Solv-8

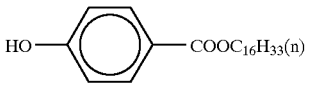

Solv-9

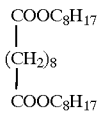

Thus, the sample No. 101 was prepared. The sample Nos. 102 to 110 were prepared in the same manner as in the preparation of the sample No. 101, except that the silver chlorobromide emulsion for the fourth layer (red sensitive layer) was changed according to Table 7.

First, the samples were exposed to light for 0.1 second through an optical wedge and a red filter. The samples were color developed according to the following processes. The optical densities of the processed samples were measured to obtain characteristic curves. The gradation at the toe was expressed by ΔLog E, which was obtained by subtracting the logarithmic value of the exposure for the reflection density of 0.2 from the logarithmic value of the exposure for the reflection density of 0.5. A sample of a small ΔLog value has a steep rise at the toe. Such a sample forms a clear and clean image.

Next, the samples were exposed to a safelight at the distance of 1 m. The safelight consists a 100 W bulb, two filters (103A, Fuji Photo Film Co., Ltd.) and a paraffin paper. The samples were then exposed to light for 0.1 second through an optical wedge and a red filter. The samples were color developed according to the following processes. The optical densities of the processed samples were measured to obtain characteristic curves. A security to the safelight was expressed by (t minutes), which is the time of exposing a sample to the safe light required for obtaining the reflection density of 0.4. The exposure was so adjusted that the exposure causes the reflection density of 0.3 on the sample that is not exposed to the safelight. A sample of a small (t) value has a high security to the safelight.

Further, the samples were preserved under 50 atmospheric pressure for one week. The samples were then exposed to light for 0.1 second through an optical wedge and a red filter. The samples were color developed according to the following processes. The optical densities of the processed samples were measured to obtain characteristic curves. The stability of the sample was expressed by ΔLog E, which was obtained by subtracting the logarithmic value of the exposure for the reflection density of 1.0 in the preserved sample from the logarithmic value of the exposure for the reflection density of 1.0 in the flesh sample. A sample of a small ΔLog value has a high stability.

Furthermore, the samples were exposed to light for 0.1 second through an optical wedge and a red filter under conditions of 25° C. and 40% relative humidity or 25° C. and 80% relative humidity. The samples were color developed according to the following processes. The optical densities of the processed samples were measured to obtain characteristic curves. The humidity dependency of the sample was expressed by ΔLog E, which was obtained by subtracting the logarithmic value of the exposure for the reflection density of 1.0 in the sample exposed at 40% relative humidity from the logarithmic value of the exposure for the reflection density of 1.0 in the sample exposed at 80% relative humidity. A sample of a small ΔLog value has a small humidity dependency.

The processes are shown below.

| Processes | Temperature | Time |
|---|---|---|
| Color development | 38.5° C. | 45 seconds |
| Bleach-fix | 30 to 25° C. | 45 seconds |
| Rinsing 1 | 30 to 25° C. | 20 seconds |
| Rinsing 2 | 30 to 25° C. | 20 seconds |
| Rinsing 3 | 30 to 25° C. | 20 seconds |
| Drying | 70 to 80° C. | 60 seconds |

The amount of the replenisher for the color developing solution was 73 ml per 1 $m^2$ of the photographic material. The volume of the tank was 500 ml. The rinsing processes were conducted as a counter current method in the order of 3 to 1. The compositions of the processing solutions are shown below.

| Color developing solution | Tank | Replenisher |
|---|---|---|
| Water | 700 ml | 700 ml |
| Sodium triisoprepylene(β)sulfonic acid | 0.1 g | 0.1 g |
| Ethylenediaminetetraacetic acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium chloride | 6.5 g | — |
| Potassium bromide | 0.03 g | — |
| Potassium carbonate | 27.0 g | 27.0 g |
| Brightening agent (WHITEX 4, Sumitomo Chemical Co., Ltd.) | 1.0 g | 3.0 g |
| Sodium sulfite | 0.1 g | 0.1 g |
| Disodium N,N-bis(sulfonatethyl)hydroxylamine | 10.0 g | 13.0 g |
| N-ethyl-N-(b-methanesulfonamido-ethyl)-3-methyl-4-aminoaniline sulfate | 5.0 g | 11.5 g |
| Water (make up to) | 1,000 ml | 1,000 ml |
| pH (25° C.) | 10.0 | 11.0 |

| Bleach-fix solution | Tank and Replenisher |
|---|---|
| Water | 600 ml |
| Ammonium thiosulfate (700 g per liter) | 100 ml |
| Ammonium sulfite | 40 g |
| Iron(III) ammonium ethylenediaminetetraacetate | 55 g |
| Disodium ethylenediaminetetraacetate | 5 g |
| Ammonium bromide | 40 g |
| Nitric acid (67%) | 30 g |
| Water (make up to) | 1,000 ml |
| pH (25° C.) adjusted with acetic acid and ammonium water | 5.8 |

An ion exchanged water was used as the rinsing solution. The calcium or magnesium content in water was not more than 3 ppm.

The results are set forth in Table 7.

TABLE 7

| Emulsion | Dopant Compound | Dopant mol | Samp. No. | Toe Δlog E | (t) Safelight | (S) Δlog E | RH Δlog E |
|---|---|---|---|---|---|---|---|
| J | None | | 101 | 0.23 | 35 | −0.05 | −0.08 |
| K | $K_3[Rh(Cl)_6]$ | $1 \times 10^{-8}$ | 102 | 0.21 | 22 | −0.10 | −0.07 |
| L | $K_3[Rh(Cl)_6]$ | $2 \times 10^{-8}$ | 103 | 0.19 | 12 | −0.14 | −0.07 |
| M | $K_3[Rh(Cl)_6]$ | $4 \times 10^{-8}$ | 104 | 0.17 | 7 | −0.18 | −0.06 |
| N | $K_2[Ru(NO)Cl_5]$ | $1 \times 10^{-8}$ | 105 | 0.20 | 19 | −0.09 | −0.07 |
| O | $K_2[Ru(NO)Cl_5]$ | $2 \times 10^{-8}$ | 106 | 0.18 | 12 | −0.14 | −0.06 |
| P | $K_2[Ru(NO)Cl_5]$ | $4 \times 10^{-8}$ | 107 | 0.17 | 6 | −0.17 | −0.06 |
| Q | $K_3[Cr(CN)_6]$ | $1 \times 10^{-8}$ | 108 | 0.21 | 33 | −0.06 | −0.04 |
| R | $K_3[Cr(CN)_6]$ | $2 \times 10^{-8}$ | 109 | 0.19 | 30 | −0.06 | −0.03 |
| S | $K_3[Cr(CN)_6]$ | $4 \times 10^{-8}$ | 110 | 0.18 | 28 | −0.07 | −0.03 |

(Remark)
(t): Security (time) to safelight
(S): Stability

EXAMPLE 8

(Emulsion T)

In 800 ml of distilled water, 32 g of lime-treated gelatin was dissolved at 40° C. To the solution, 3.3 g of sodium chloride was added. The mixture was heated to 70° C. To the mixture, a solution of 100 g of silver nitrate in 400 ml of distilled water and a solution of 34.4 g of sodium chloride in 400 ml of distilled water were added at 70° C. for 43 minutes. To the mixture, a solution of 60.0 g of silver nitrate in 200 ml of distilled water and a solution of 20.6 g of sodium chloride and $K_3[Fe(CN)_6]$ ($1.0\times10^{-5}$ mol per 1 mol of the whole amount of silver chlorobromide) in 200 ml of distilled water were further added at 70° C. for 18 minutes. The mixture was cooled to 40° C. The red sensitizing dye ($4\times10^{-5}$ mol based on 1 mol of silver halide) used in Example 7 was added to the mixture. To the mixture, a silver bromine fine emulsion (average grain size: 0.05 μm) was added in such an amount that the final bromide content was 1.0 mol %. The fine emulsion contains $K_3[Fe(CN)_6]$ in the amount of $1.2\times10^{-6}$ mol per 1 mol of the whole amount of silver chlorobromide. The emulsion was subjected to a gold-sulfur sensitization under the optimum conditions. Thus silver chlorobromide emulsion (bromide: 1.0 mol %) was prepared.

(Emulsion U)

An Emulsion U was prepared in the same manner as in the preparation of the Emulsion T, except that $1.5\times10^{-8}$ mol (per 1 mol of the whole amount of silver chlorobromide) of $K_3[RhCl_6]$ was added to the sodium chloride solution for the second addition.

(Emulsion V)

An Emulsion V was prepared in the same manner as in the preparation of the Emulsion T, except that $1.5\times10^{-8}$ mol (per 1 mol of the whole amount of silver chlorobromide) of $K_3[Cr(CN)_6]$ was added to the sodium chloride solution for the second addition.

The emulsions T to V were observed with an electron microscope. Each of the emulsions T to V has an average grain size of 0.49 μm. The shape of the grain was cubic. The distribution coefficient was 0.09. Further, the emulsions were observed with a X-ray analysis. As a result, each of the emulsions T to V has a weak peak in the range of the silver bromide content of 10 to 40 mol %.

A sample No. 201 was prepared in the same manner as in the preparation of the sample No. 101 in Example 7, except that the emulsion K was used for the red sensitive layer and 1-(5-methylureidophenyl)-5-mercaptotetrazole was not to the blue, green and red sensitive layers.

The sample Nos. 202 to 209 were prepared in the same as in the preparation of the sample No. 201, except that the emulsion and additives for the red sensitive layer he surface pH were changed according to Table 8.

The samples were evaluated in the same manner as in Example 7. The results are set forth in Table 8.

TABLE 8

| Samp. No. | Dopant Compound | Additive | Surface pH | Toe Δlog E | (t) Safelight | (S) Δlog E | RH Δlog E |
|---|---|---|---|---|---|---|---|
| 201 | None | None | 5.9 | 0.23 | 35 | −0.10 | −0.08 |
| 202 | None | III | 6.2 | 0.23 | 35 | −0.05 | −0.08 |
| 203 | None | IV-1 | 5.9 | 0.22 | 34 | −0.06 | −0.08 |
| 204 | $K_3[Rh(Cl)_6]$ | None | 6.0 | 0.19 | 13 | −0.16 | −0.08 |
| 205 | $K_3[Rh(Cl)_6]$ | III | 5.9 | 0.20 | 12 | −0.14 | −0.07 |
| 206 | $K_3[Rh(Cl)_6]$ | IV-1 | 6.1 | 0.19 | 13 | −0.13 | −0.08 |
| 207 | $K_3[Cr(CN)_6]$ | None | 6.0 | 0.19 | 30 | −0.09 | −0.05 |
| 208 | $K_3[Cr(CN)_6]$ | III | 5.8 | 0.18 | 33 | −0.06 | −0.03 |
| 209 | $K_3[Cr(CN)_6]$ | IV-1 | 5.9 | 0.19 | 32 | −0.07 | −0.04 |
| 210 | $K_3[Cr(CN)_6]$ | IV-1 | 4.2 | 0.20 | 33 | −0.09 | −0.04 |

(Remark)
III: Compound III-2-2
(t): Security (time) to safelight
(S): Stability

EXAMPLE 9

Preparation of Cubic Silver Bromide Emulsion

In 870 ml of water, 36 g of deionized gelatin and 0.25 g of potassium bromide were dissolved. To the solution, 36 ml of 0.088 M silver nitrate aqueous solution (solution 15) and 36 ml of 0.088 M potassium bromide aqueous solution (solution 16) were added according to a double jet method for 10 minutes while stirring the gelatin solution at 75° C. Further, 179 ml of the solution 15 and 176 ml of the solution 16 were added to the mixture according to a double jet method for 7 minutes. Furthermore, 1010 ml of 0.82 M silver nitrate aqueous solution (solution 17) was added to the mixture for 78 minutes while accelerating the feeding rate from the initial rate of 1.8 ml per minute. Simultaneously, 0.90 M potassium bromide aqueous solution (solution 18) was added to the mixture while controlling the silver potential at +100 mV (based on calomel electrode). After 5 minutes, the mixture was cooled to 35° C. Soluble salts were removed according to a conventional flocculation method.

After the mixture was heated to 40° C., 50 g of gelatin was further dissolved in the mixture. Further, potassium bromide and phenol were added to the mixture. The obtained emulsion was adjusted to pH 6.5. Thus, a monodispersed cubic silver bromide emulsion was obtained. The average edge length of the cubic grains was 0.65 μm. The distribution coefficient was 10%.

Preparation of Cubic Silver Bromide Emulsion Doped With $(NH_4)_2[RhCl_5(H_2O)]$ The procedure of the above-mentioned preparation of the emulsion was repeated except that $1\times10^{-8}$ mol, $1\times10^{-7}$ M mol or $1\times10^{-6}$ mol of $(NH_4)_2[RhCl_5(H_2O)]$ was added to the solution 18.

Preparation of Cubic Silver Bromide Emulsion Doped With $K_3[Cr(CN)_6]$

The procedure of the above-mentioned preparation of the emulsion was repeated except that $1\times10^{-8}$ mol, $1\times10^{-7}$ mol or $1\times10^{-6}$ mol of $K_3[Cr(CN)_6]$ (based on 1 mol of silver halide) was added to the solution 8.

The emulsions were coated on the support in the same manner as in Example 1, except that the MMA-1 developing solution was used in place of the MMA-1* developing solution. The obtained samples were evaluated in the same manner as in Example 1. The results are set forth in Table 9.

TABLE 9

| Emulsion | Dopant Compound | Dopant Amount | Fog | Sensitivity | Gradation | Toe density |
|---|---|---|---|---|---|---|
| a | None | | 0.07 | 100 | 2.2 | 0.35 |
| b-1 | $(NH_4)_2[RhCl_5(H_2O)]$ | $1\times10^{-8}$ | 0.06 | 67 | 2.1 | 0.34 |
| b-2 | $(NH_4)_2[RhCl_5(H_2O)]$ | $1\times10^{-7}$ | 0.06 | 23 | 3.0 | 0.28 |
| b-3 | $(NH_4)_2[RhCl_5(H_2O)]$ | $1\times10^{-6}$ | 0.05 | 7 | 3.9 | 0.25 |
| c-1 | $K_3[Cr(CN)_6]$ | $1\times10^{-8}$ | 0.06 | 80 | 2.3 | 0.34 |
| c-2 | $K_3[Cr(CN)_6]$ | $1\times10^{-7}$ | 0.05 | 57 | 2.6 | 0.27 |
| c-3 | $K_3[Cr(CN)_6]$ | $1\times10^{-6}$ | 0.05 | 9 | 5.7 | 0.19 |

EXAMPLE 10

The emulsions a, b-2, b-3, c-1 and c-2 prepared in Example 9 were subjected to a chemical sensitization at 60° C. under the optimum conditions. At the chemical sensitization, $9.2\times10^{-6}$ mol of sodium thiosulfate, $2.1\times10^{-6}$ mol of potassium chloroaurate and $2.1\times10^{-6}$ mol of potassium thiocyanate were used based on 1 mol of silver. The samples were prepared and evaluated in the same manner as in Example 9. The results are set forth in Table 10.

TABLE 10

| Emulsion | Dopant Compound | Dopant Amount | Fog | Sensitivity | Gradation | Toe density |
|---|---|---|---|---|---|---|
| a | None | | 0.10 | 100 | 1.8 | 0.40 |
| b-2 | $(NH_4)_2[RhCl_5(H_2O)]$ | $1\times10^{-7}$ | 0.08 | 56 | 2.4 | 0.38 |
| b-3 | $(NH_4)_2[RhCl_5(H_2O)]$ | $1\times10^{-6}$ | 0.09 | 8 | 3.0 | 0.26 |
| c-2 | $K_3[Cr(CN)_6]$ | $1\times10^{-7}$ | 0.07 | 69 | 3.0 | 0.32 |
| c-3 | $K_3[Cr(CN)_6]$ | $1\times10^{-6}$ | 0.05 | 13 | 4.3 | 0.25 |

EXAMPLE 11

Preparation of Cubic Silver Chloride Emulsions Doped With $K_3[Fe(CN)_6]$, $K_3[Ru(CN)_6]$, $K_3[Co(CN)_6]$ or $K_3[Ir(CN)_6]$ Cubic silver chloride emulsions were prepared in the same manner as in the preparation of the emulsion A in the Example 1, except that $1\times10^{-6}$ mol of $K_3[Fe(CN)_6]$, $K_3[Ru(CN)_6]$, $K_3[Co(CN)_6]$ or $K_3[Ir(CN)_6]$ was added to the solution 4.

The samples were prepared and evaluated in the same manner as in the Examples 1.

The results are set forth in Table 11. In Table 11, the results of the sample not doped and the sample doped with $K_3[Cr(CN)_6]$ in Example 1 are set forth again for reference.

TABLE 11

| Dopant | Fog | Sensitivity | Gradation | Toe density |
|---|---|---|---|---|
| None | 0.06 | 100 | 2.6 | 0.32 |
| $K_3[Cr(CN)_6]$ | 0.05 | 10 | 5.7 | 0.07 |
| $K_3[Fe(CN)_6]$ | 0.05 | 99 | 2.8 | 0.31 |
| $K_3[Ru(CN)_6]$ | 0.05 | 97 | 2.7 | 0.30 |
| $K_3[Co(CN)_6]$ | 0.05 | 95 | 2.5 | 0.32 |
| $K_3[Ir(CN)_6]$ | 0.05 | 101 | 2.6 | 0.33 |

EXAMPLE 12

The emulsions used in Example 11 were subjected to a chemical sensitization at 60° C. under the optimum conditions. At the chemical sensitization, $1\times10^{-2}$ mol of silver bromide fine emulsion, $2.5\times10^{-6}$ mol of sodium thiosulfate and $3\times10^{-7}$ mol of chloroauric acid were used based on 1 mol of silver. The samples were prepared and evaluated in the same manner as in Example 1. The results are set forth in Table 12.

Cubic silver chloride emulsions were prepared in the same manner as in the preparation of the emulsion A in the Example 1, except that $1\times10^{-6}$ mol of $K_3[Fe(CN)_6]$, $K_3[Ru(CN)_6]$, $K_3[Co(CN)_6]$ or $K_3[Ir(CN)_6]$ was added to the solution 4.

TABLE 12

| Dopant | Fog | Sensitivity | Gradation | Toe density |
|---|---|---|---|---|
| None | 0.10 | 100 | 2.2 | 0.36 |
| $K_3[Cr(CN)_6]$ | 0.05 | 9 | 6.4 | 0.15 |
| $K_3[Fe(CN)_6]$ | 0.14 | 50 | 2.4 | 0.35 |
| $K_3[Ru(CN)_6]$ | 0.05 | 52 | 2.3 | 0.37 |
| $K_3[Co(CN)_6]$ | 0.05 | 73 | 2.2 | 0.33 |
| $K_3[Ir(CN)_6]$ | 0.05 | 75 | 2.4 | 0.36 |

We claim:

1. A surface latent image silver halide photographic material which comprises a support and at least one surface latent image silver halide emulsion layer provided thereon, wherein surface latent image silver halide grains of the emulsion layer contain a complex represented by formula (I):

$$[Cr(CN)_{6-n}L_n]^{m-} \quad (I)$$

wherein L is $H_2O$ or OH; n is 0 or 1; and m is 3 or 4.

2. The surface latent image silver halide photographic material as claimed in claim 1, wherein the surface latent image silver halide grains contain the complex represented by formula (I) in an amount of $1\times10^{-8}$ to $1\times10^{-2}$ mol based on 1 mol of silver halide.

3. The surface latent image silver halide photographic material as claimed in claim 1, wherein the surface latent image silver halide grains comprise silver chloride in an amount of not less than 50 mol %.

4. The surface latent image silver halide photographic material as claimed in claim 3, wherein the surface latent image silver halide grains comprise silver chloride in an amount of not less than 80 mol %.

5. The surface latent image silver halide photographic material as claimed in claim 1, wherein the surface latent image silver halide emulsion layer further contains a mercapto heterocyclic compound.

6. The surface latent image silver halide photographic material as claimed in claim 5, wherein the surface latent image silver halide emulsion layer contains the mercapto heterocyclic compound in an amount of $1\times10^{-5}$ to $5\times10^{-2}$ mol based on 1 mol of silver halide.

7. The surface latent image silver halide photographic material as claimed in claim 1, wherein the surface latent image silver halide emulsion layer further contains a tetrazaindene compound.

8. The surface latent image silver halide photographic material as claimed in claim 7, wherein the surface latent image silver halide emulsion layer contains the tetrazaindene compound in an amount of $1\times10^{-5}$ to $3\times10^{-1}$ mol based on 1 mol of silver halide.

9. The surface latent image silver halide photographic material as claimed in claim 1, wherein the surface latent image silver halide grains further contain a complex ion of iron, ruthenium, osmium, cobalt, rhodium or iridium.

10. The surface latent image silver halide photographic material as claimed in claim 1, wherein the surface latent image silver halide photographic material has a surface pH value in the range of 4.0 to 6.5.

11. The surface latent image silver halide photographic material as claimed in claim 10, wherein the surface latent image silver halide photographic material has a surface pH value in the range of 5.0 to 6.5.

12. The surface latent image silver halide photographic material as claimed in claim 1, wherein n is 0 and m is 3.

13. The surface latent image silver halide photographic material as claimed in claim 1, wherein said complex of formula (I) is selected from the group consisting of formula (I-1), (I-2) and (I-3):

$$[Cr(CN)_6]^{3-} \quad \text{(I-1)}$$

$$[Cr(CN)_5(H_2O)]^{3-} \quad \text{(I-2)}$$

and $$[Cr(CN)_5(OH)]^{4-} \quad \text{(I-3)}.$$

* * * * *